US007703398B2

(12) United States Patent
Bräuning et al.

(10) Patent No.: US 7,703,398 B2
(45) Date of Patent: Apr. 27, 2010

(54) TABLE, ESPECIALLY CONFERENCE AND OFFICE TABLE

(75) Inventors: Egon Bräuning, Weil am Rhein (DE); Erwan Bouroullec, Paris (FR); Ronan Bouroullec, Paris (FR)

(73) Assignee: Vitra Patente AG, Muttenz (CH)

( * ) Notice: Subject to any disclaimer, the term of this patent is extended or adjusted under 35 U.S.C. 154(b) by 972 days.

(21) Appl. No.: 10/526,347

(22) PCT Filed: Aug. 28, 2003

(86) PCT No.: PCT/CH03/00586

§ 371 (c)(1),
(2), (4) Date: Nov. 14, 2005

(87) PCT Pub. No.: WO2004/021830

PCT Pub. Date: Mar. 18, 2004

(65) Prior Publication Data

US 2006/0162626 A1 Jul. 27, 2006

(30) Foreign Application Priority Data

Sep. 3, 2002 (CH) ..... 1494/02

(51) Int. Cl.
*A47B 37/00* (2006.01)

(52) U.S. Cl. ..... 108/50.02; 108/155

(58) Field of Classification Search ..... 108/83, 108/87, 89, 187, 155, 156, 158, 143, 50.01, 108/50.02; 248/188, 188.1; 297/440.1; 312/223.3
See application file for complete search history.

(56) References Cited

U.S. PATENT DOCUMENTS

| | | | | |
|---|---|---|---|---|
| 949,119 | A * | 2/1910 | Gruender | 108/83 |
| 3,136,517 | A * | 6/1964 | Gariepy | 248/188 |
| 4,601,226 | A * | 7/1986 | McClintock | 83/415 |
| 5,186,425 | A | 2/1993 | Keusch et al. | |

(Continued)

FOREIGN PATENT DOCUMENTS

DE 197 33 435 A1 2/1999

(Continued)

OTHER PUBLICATIONS

International Search Report dated Nov. 10, 2003 and issued by the European Patent Office in connection with International Application No. PCT/CH2003/000586.

(Continued)

*Primary Examiner*—Janet M Wilkens
(74) *Attorney, Agent, or Firm*—McCarter & English, LLP

(57) ABSTRACT

A table is provided which has variable dimensions, especially a long length, and is mainly used in offices and conferences. The base of the table is supported by feet (6) and carries table leaves (1,1) which are brought together at the longitudinal sides thereof, and an insert (8,81) which can be inserted in-between the leaves, can have different configurations and can be used as a support for various structures. The base of the table includes at least two transversal supports (2) provided with a central sunken channel region (20) from which two extension arms (21) respectively extended in opposite directions, the feet (6) being mounted on the arms, and lateral struts (4) supporting the table leaves (1,1) being arranged on the outside.

17 Claims, 21 Drawing Sheets

U.S. PATENT DOCUMENTS

Figure 1A:
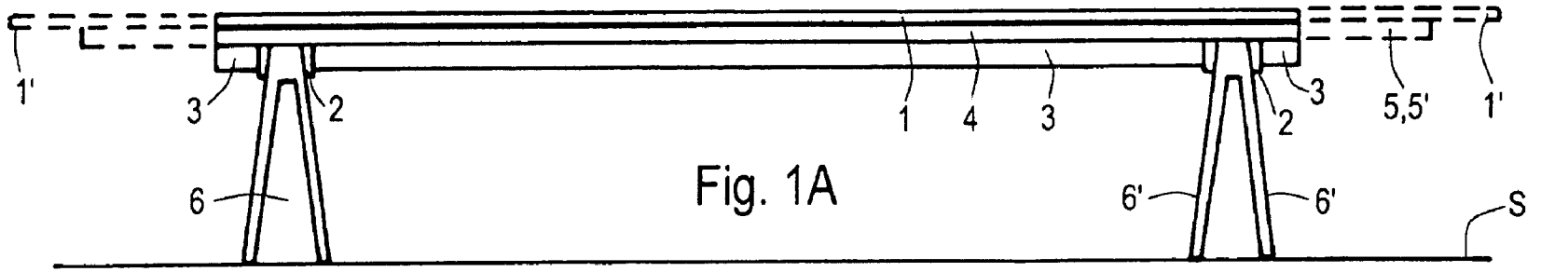

| | | | | |
|---|---|---|---|---|
| 5,638,759 | A | 6/1997 | Klugkist | |
| 5,666,888 | A * | 9/1997 | Dame et al. | 108/147.21 |
| 6,327,983 | B1 | 12/2001 | Cronk et al. | |
| 7,111,564 | B2 * | 9/2006 | Chang | 108/155 |
| 2003/0136316 | A1 * | 7/2003 | Nicoletti | 108/158 |
| 2005/0284341 | A1 * | 12/2005 | Klassy et al. | 108/50.02 |
| 2006/0096506 | A1 * | 5/2006 | Brauning et al. | 108/50.02 |
| 2007/0261614 | A1 * | 11/2007 | Weissenrieder et al. | 108/158.12 |

FOREIGN PATENT DOCUMENTS

| | | | |
|---|---|---|---|
| DE | 299 22 976 | U1 | 3/2000 |
| DE | 102 28 126 | A1 | 3/2003 |
| EP | 0 179 410 | A2 | 4/1986 |
| EP | 0 594 939 | B1 | 5/1994 |
| WO | WO 2004/021829 | A1 | 3/2004 |

OTHER PUBLICATIONS

International Search Report dated Nov. 24, 2003 and issued by the European Patent Office in connection with International Application No. PCT/CH2003/000585.

U.S. Appl. No. 10/526,415 entitled "Table, Especially Office and Conference Table", filed Mar. 2, 2005, Inventors: Brauning et al.

* cited by examiner

TABLE, ESPECIALLY CONFERENCE AND OFFICE TABLE

FIELD OF APPLICATION OF THE INVENTION

The present invention relates to a table of variable dimensions, in particular of relatively long lengths, comprising a substructure, which is supported by legs placed on a standing surface, and a tabletop placed onto the substructure. The table is primarily used in the office and conference sector. This necessitates a stable construction and routing power supply and communication cables to the table and installing and accommodating them thereon.

PRIOR ART

Numerous designs of large-size tables are known. Sufficient stability of the tables, primarily in the case of relatively large dimensions, in particular in the case of a relatively long construction, is possible only by means of relatively solid under-structures with complicated, material-intensive and heavy frames, including the attaching of additionally supporting legs. This makes the tables more expensive, restricts the design freedom and generally requires the separate provision of cable ducts or cable clips for holding the electrical installations for supplying power and computer networking that are indispensable nowadays on office and conference tables.

OBJECT OF THE INVENTION

In view of the previous disadvantages in the structural design of known tables, the object of the invention is to propose a table having reliable stability even in the case of relatively large dimensions, in particular in the case of a relatively long construction. The intention here is for the substructure used to be able to be produced in a relatively simple manner and to be less costly and use less material and not to unduly increase the overall weight, and the intention is for it to be able to be easily cut to a desired table size. A further object of the invention is to design the table in a manner such that it can be extended and to enable the supplying and accommodating of electrical installations for the supply of power and connection of networked computers. An additional object is to propose an effective height-leveling means, which is practical in terms of handling and is visually unobtrusive, in the table legs in order to compensate for unevenesses in the standing surface. Finally, it is the object of the invention to attach a container under the table in a releasable manner and in a freely selected position, the container being used, in particular, for the insertion of a computer.

SUMMARY OF THE INVENTION

The table according to the invention comprises a substructure, which is supported by legs placed on a standing surface, and a tabletop placed onto the substructure. The substructure is formed at least from two transverse supports which in each case in the center have a lowered channel zone from which extend in opposite directions respective extension arms which have a leg mount for the fitting-on of the legs and a strut mount. The transverse supports are arranged, spaced apart from each other in parallel, transversely with respect to the longitudinal extent of the table. The substructure furthermore, comprises a channel which, in the longitudinal extent of the table, is secured on the at least two transverse supports, thus producing a double T in top view. Finally, the substructure includes respective side struts which, in the longitudinal extent of the table, bridge the strut mounts of the transverse supports, which strut mounts are placed in each case on one side of the table.

The features below refer to special embodiments of the table: the channel is upwardly open and preferably has a trapezoidal cross section, but also could be U-shaped, V-shaped or rectangular. The channel zone in the transverse supports is of complementary design to the cross section of the channel. The attached legs are double legs and are attached to the leg mounts of the transverse supports in such a manner that the two legs define a plane which points in the longitudinal direction of the table. The lower leg portions of the two legs arranged opposite each other are preferably spread further apart than their upper head portions. The area above the channel is intended for the insertion of inserts, a tabletop being fitted from both sides onto the inserts.

The channel is preferably provided for table lengths of greater than 2.50 m, with transverse supports and legs having to be provided only in the region of the front ends of the table in each case, i.e. it being possible to dispense with transverse supports and legs inserted in between. Only in the case of large lengths is the additional fitting of transverse supports and legs provided. The channel, which preferably consists of sheet metal which is, e.g., 2.0 mm thick, has an average width which is a multiple of the height. On both sides of the channel, on the plane of the tabletops which are to be placed on, a respective surround is provided for fixing the tabletops at their longitudinal inner edges, the surround preferably being in the form of an angled stop with an edge engaging over it at the top and under which the longitudinal inner edges can be slid. The tabletops are fixed, on the other hand, in the vicinity of their longitudinal outer edges, to the side struts. The strut mounts on the transverse supports are of upwardly open V-profile, and the side struts are essentially likewise of upwardly open V-profile which, at least with the pointed, lower region, find space with a suitable shape in the strut mounts. The V-profile has at the top on both sides horizontal chamfered portions which are used as a support for and securing of the tabletops. The fastening between the side struts and the transverse supports and between the side struts and the tabletops is preferably realized in a spot-type manner by means of screws.

In the case of a side strut of the second version, at least one of the horizontal chamfered portions, which are present at the top on both sides, of the side strut is adjoined by a downwardly pointing transition which opens into a support edge, as a result of which, when the tabletop is resting on it, a gap remains between the underside thereof and the support edge. The side strut is preferably of symmetrical cross section and therefore has the same contours to both flank sides. A container with a useful space and an adaptor region intended for fitting onto the side strut are provided. The container is dimensioned for the insertion of a CPU of a computer. The adaptor region has a channel-like depression which runs longitudinally, extends over the width of the container and in which the V-profile of the side strut together with the strut mount, which supports the latter, of the transverse support finds space. The container useful space is formed by a base and the two side walls extending upward therefrom. Like the container front side, the rear side and the topside are preferably open, thus enabling free access into the container from the front and rear. At the top of the depression—facing the rear side—there is an upwardly directed stop edge, and running parallel to the latter on the depression—facing the front side—is a bent-over portion which points toward the depression. In the fitted state, the bent-over portion of the container engages over the support edge and the stop edge of the container is present on the second support edge of the side strut, as it were from the rear. The suspension and position of the center of gravity of the container in the fitted state cause it to be aligned toward the center of the table, the supported tendency of the container to tilt being reinforced as said container is loaded.

On both sides of the channel, below the plane of the tabletops to be placed on, a respective supporting edge, which points away from the channel, is provided for supporting and fixing the tabletops at their longitudinal inner edges. In addition, on both sides of the channel, below the plane of the inserts to be placed on, set-down surfaces pointing into the channel are arranged in each case, in order to support said inserts. The supporting edges and the set-down surfaces are formed by a profiled material strip fixed on the channel. The surround is advantageously a continuation of the wall of the channel. In the channel, preferably in the base surface thereof, installation apertures are provided as a means of access for lines and/or installations. The table can be provided with a tabletop extension which is attached transversely and is supported by bridge struts which are fastened, on the one hand, in the respectively aligned side strut on the existing tabletops and, on the other hand, in strut extensions of the same profile, which are provided below the tabletop extension.

In order to secure the legs, on the head portion thereof and on the leg mounts on the transverse supports there are mutually complementary screwing elements. At the leg, one leg portion extends from the head portion to the standing surface. Two legs emerge from the head portion, said legs spreading apart and being formed in each case by a leg profile. A height-leveling device is contained in the leg, which device acts on both leg ends. There emerges from each lower leg end a base element which is arranged displaceably, can be adjusted by means of the height-leveling device and the set-down surface of which is supported on the standing surface. The height-leveling device comprises an adjusting screw which is accessible from the outside, is preferably arranged in the head portion and carries along a rotating spindle on which a rocker element is mounted in an oscillating manner.

In the leg portion with the two legs spread apart, a respective axially displaceable slide rod is mounted in the respective leg profile of said leg. The upper ends of the two slide rods butt against the rocker element which determines, by means of its set height position, the push-in depth of the slide rods, the slide rods acting on the respective base element. The base element has a cross section which corresponds in principle to the clear internal cross section of the leg profile at the lower leg end. The set-down surface, which is situated right at the bottom of the base element, is an oblique plane which compensates for the oblique position of the leg portion with respect to the standing surface. The base element and the coupling element may form an integral constructional unit. As an alternative, a coupling element, to which the slide rod is fastened at the top and the base element is fastened at the bottom, is fitted between the lower end of a slide rod and a base element. The coupling element, which is separate or is connected integrally to the base element, is arranged in the leg profile in a manner such that it can be displaced axially over a defined region. The leg profile has, in principle, a U-shaped cross section with a rear wall and the two side walls which are adjacent to the latter and lie opposite each other. A leg covering is used for covering the open side lying opposite the rear wall.

Differently configured inserts which can have at least one aperture and/or a groove can be placed over the channel. In this case, the aperture may be used for receiving a socket unit or for the insertion of a support, the support, for example, bearing a light.

Differently constructed structures can be inserted into the groove, for example in the form of a possibly axially displaceable and/or rotatable, horizontal panel, a possibly axially displaceable and/or rotatable book/file support or a vertically standing screen. Different structures are provided for arrangement at and/or on the tabletop, which structures can easily be positioned and displaced or removed again, for example by sliding over the table edge. Such structures are, for example:

- a half-height, panel-shaped side screen which forms a vertical delimitation on the table from the adjacent position and has, for example, an incision for securing it;
- a placemat which lies on the tabletop, therefore defines a workplace and has, for example, a bent-over edge at the front for securing it;
- a utensil tray or file/book support which sits on the tabletop and is provided, for example, with a bent-over edge at the front for securing it;
- a high, panel-shaped side screen with an upper part standing above the tabletop and a lower part which forms a vertical delimitation into the vicinity of the standing surface, the side screen having, for example, an incision for securing it; and
- a collecting container which extends essentially below the tabletop and has, for example, an incision for securing it.

The particular advantages of the table according to the invention reside essentially in the stability which is achieved, even in the case of a relatively long construction, this being achieved while using a substructure, which can be produced in a relatively simple manner and is less costly and uses less material and is in the form of a large-volume channel which is supported by erected transverse supports. The transverse supports which are also used for securing the legs, may be positioned at any desired positions along the channel. The interior volume of the channel and the installation apertures enable electrical devices to be supplied and accommodated. The various inserts which can be placed on and different structures permit a design which is matched to the individual requirements.

The transversal supports (2) are interspaced in a parallel manner, perpendicularly in relation to the longitudinal direction of the table. An upwardly open sheet metal channel (3) having a preferably trapeziform cross-section is fixed in the longitudinal direction of the table on the two transversal supports (2). Containers (9') for CPUs are suspended below the table in free positions on the lateral struts (4). The particular advantages of said table are essentially the stability, even for a long structure, and relatively low construction costs. The freedom in the dimensioning, the various inserts (8,81) and the different structures create a design which is adapted to individual requirements.

BRIEF DESCRIPTION OF THE ACCOMPANYING DRAWINGS

Figure 1B:
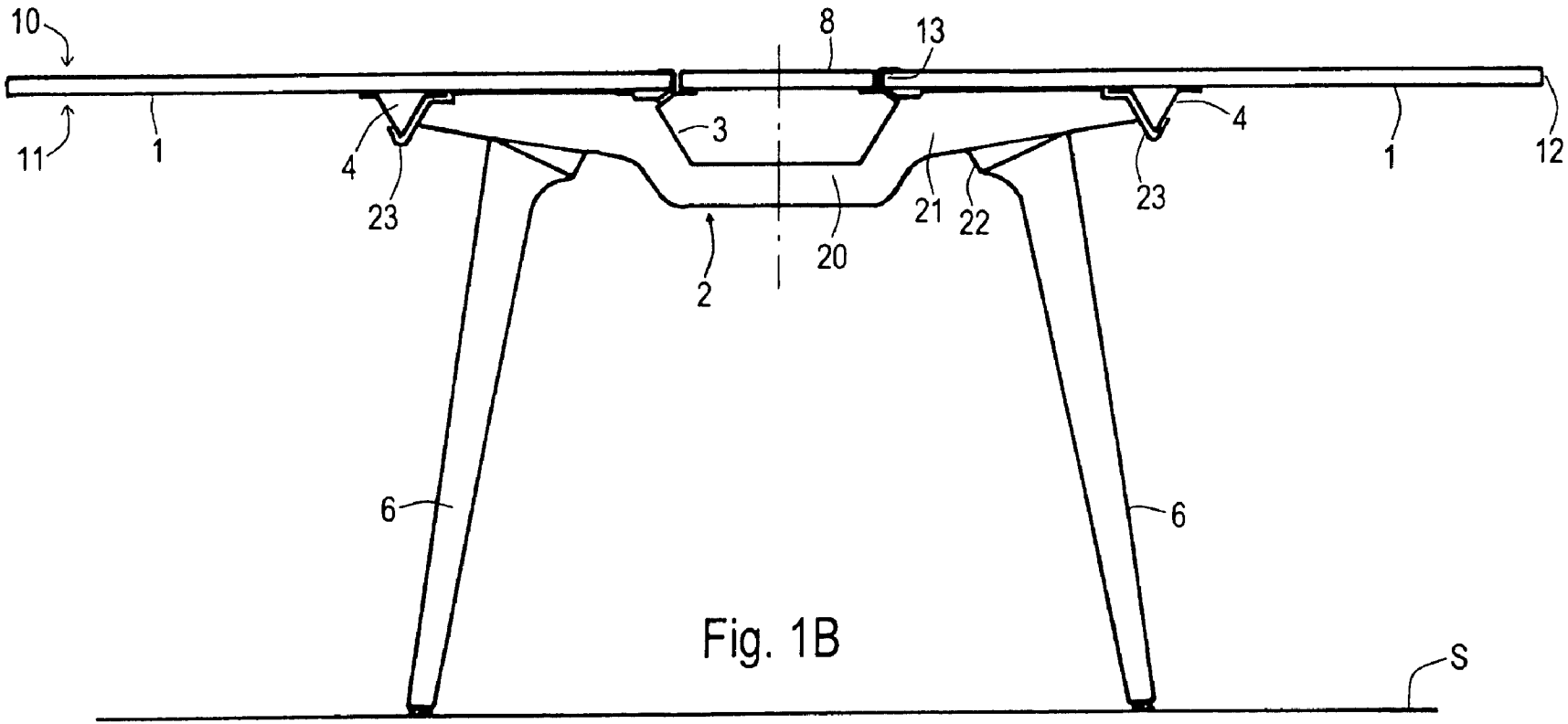
Figure 2A:
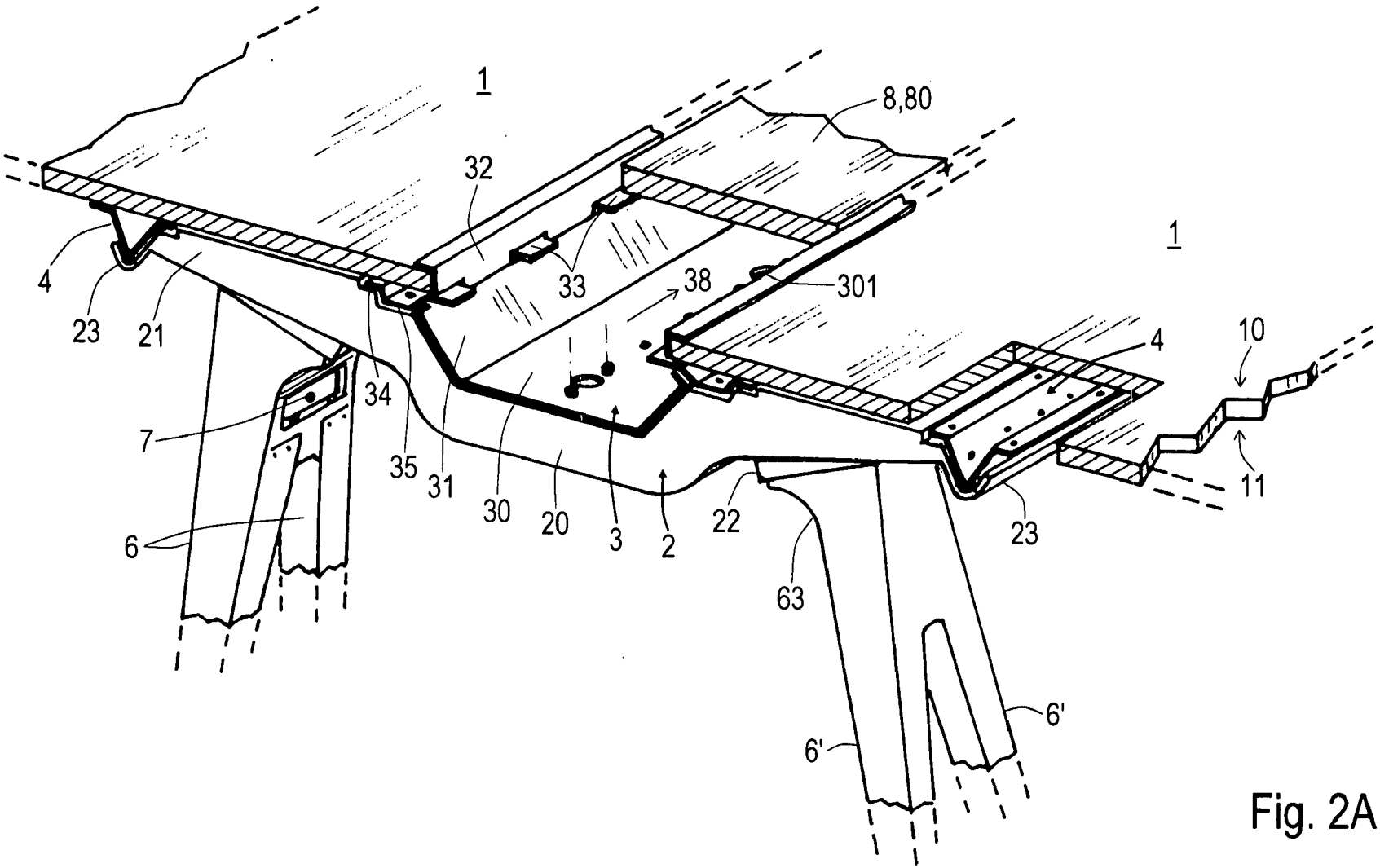
Figure 2B:
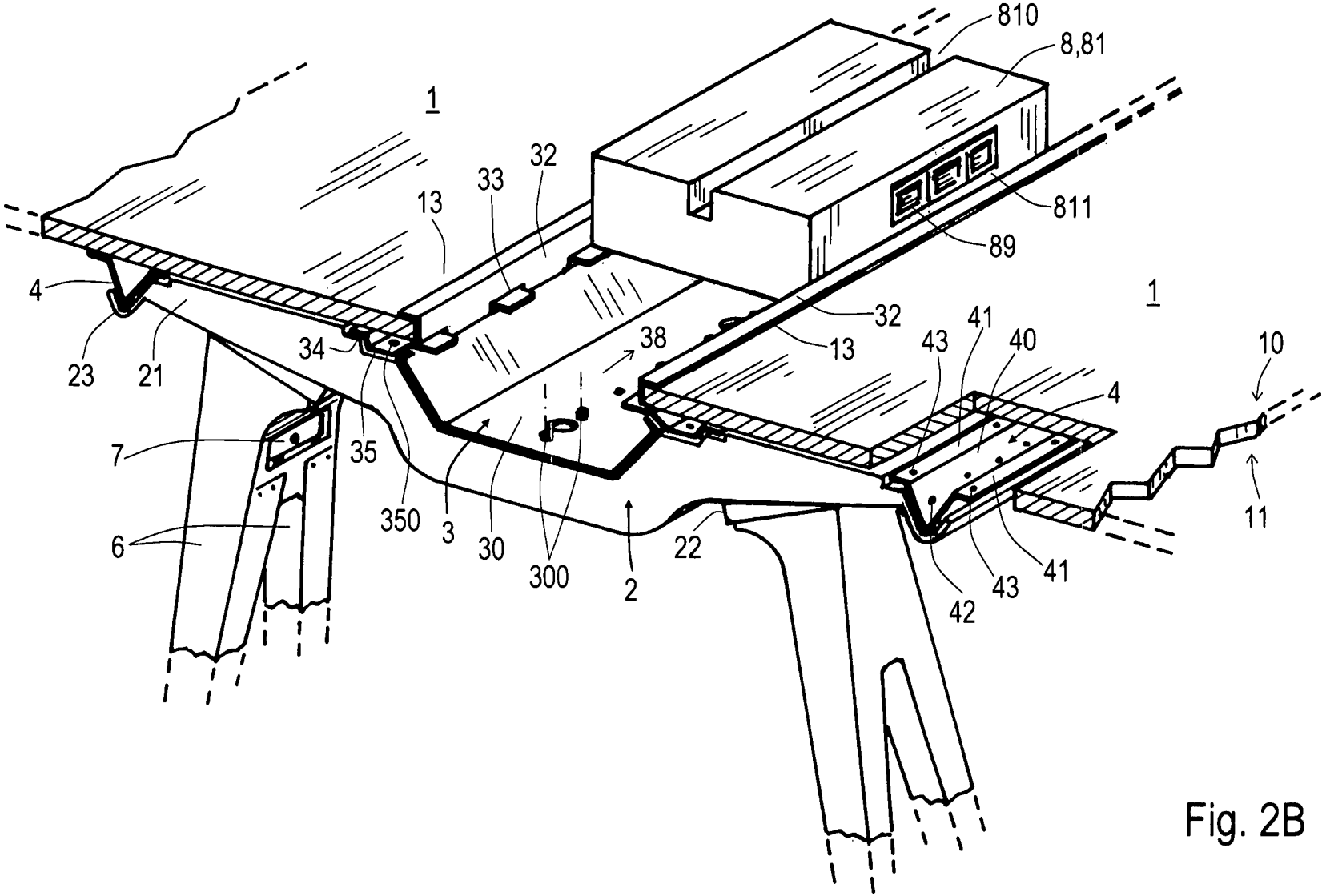
Figure 2C:
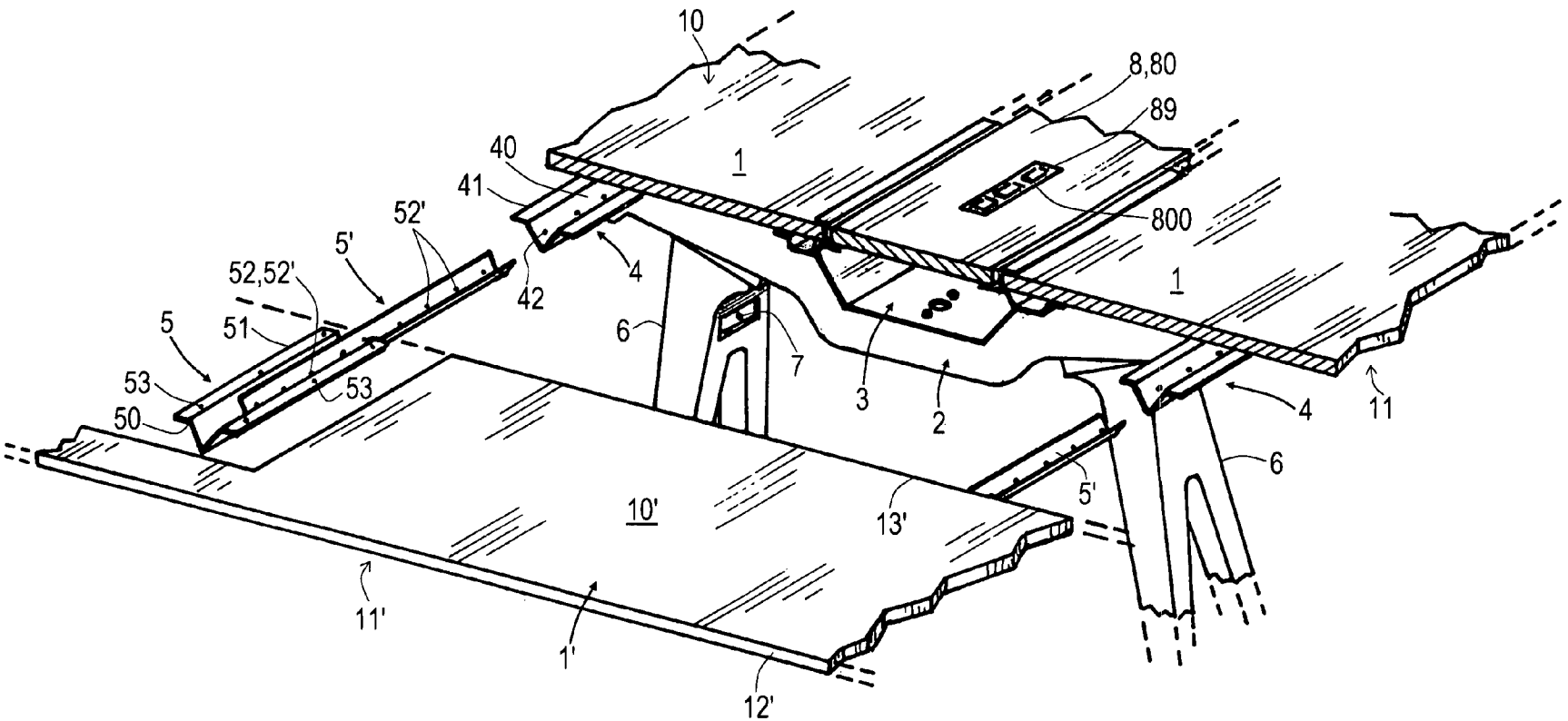
Figure 3A:
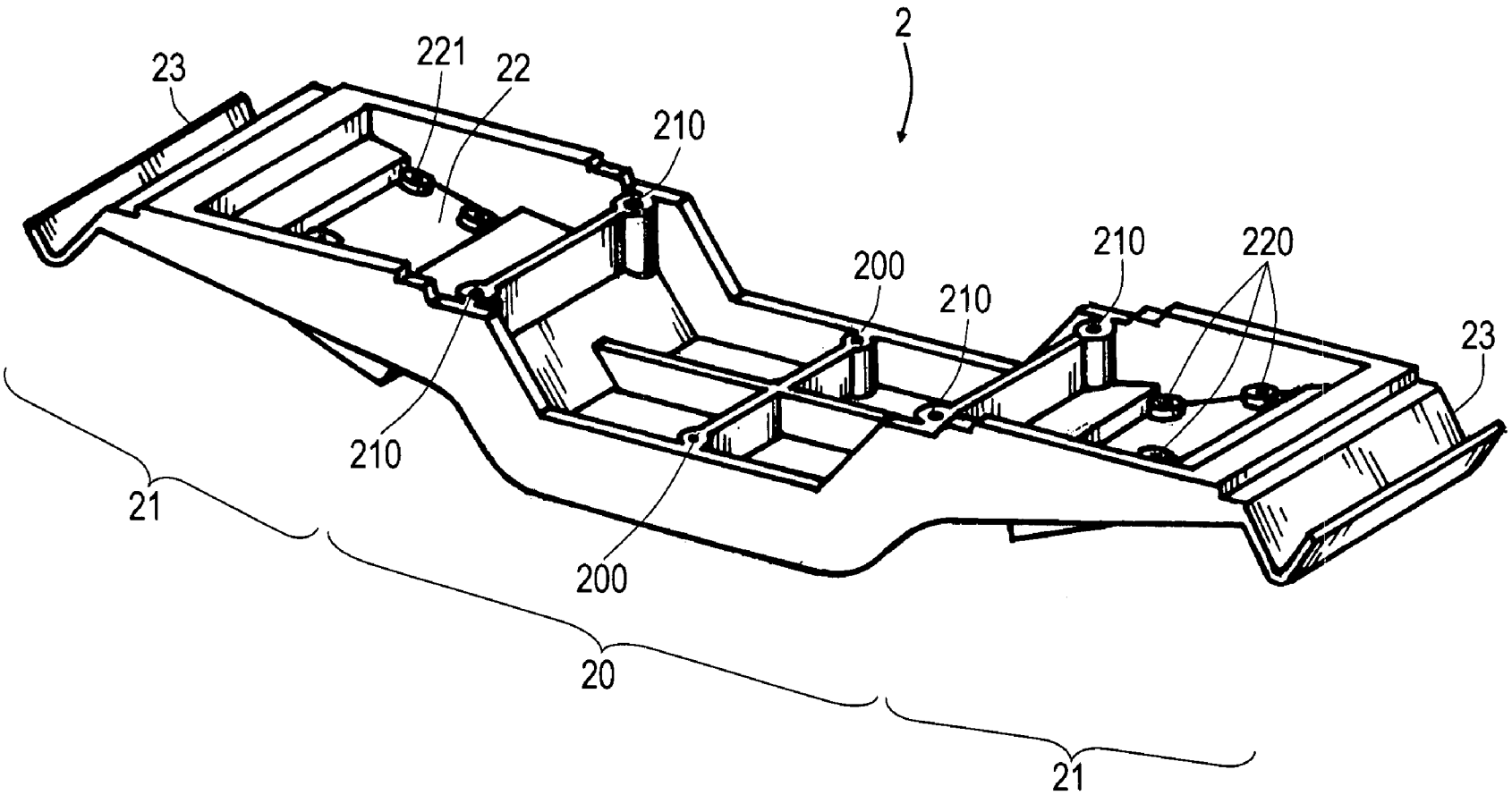
Figure 3B:
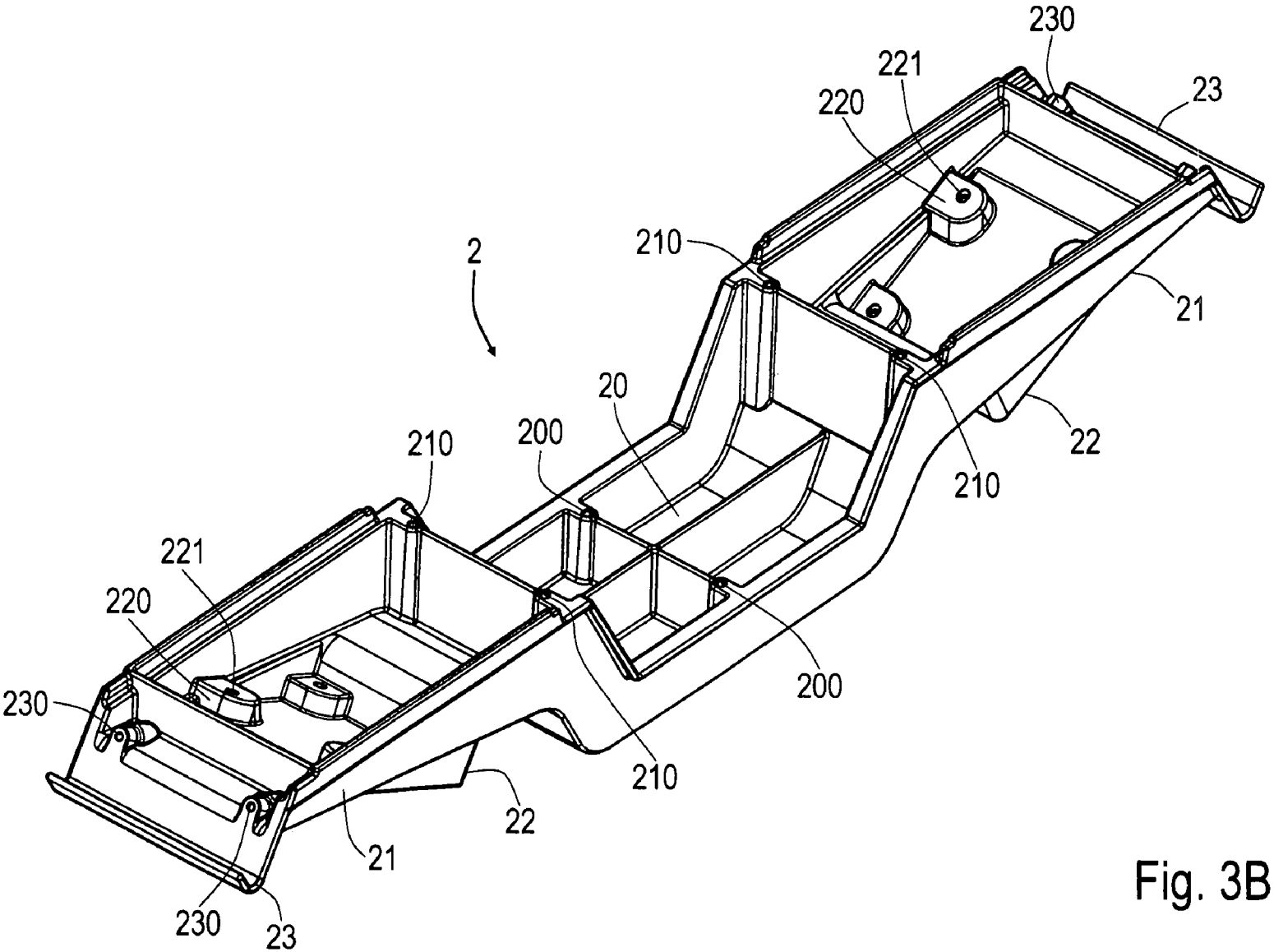
Figure 3C:
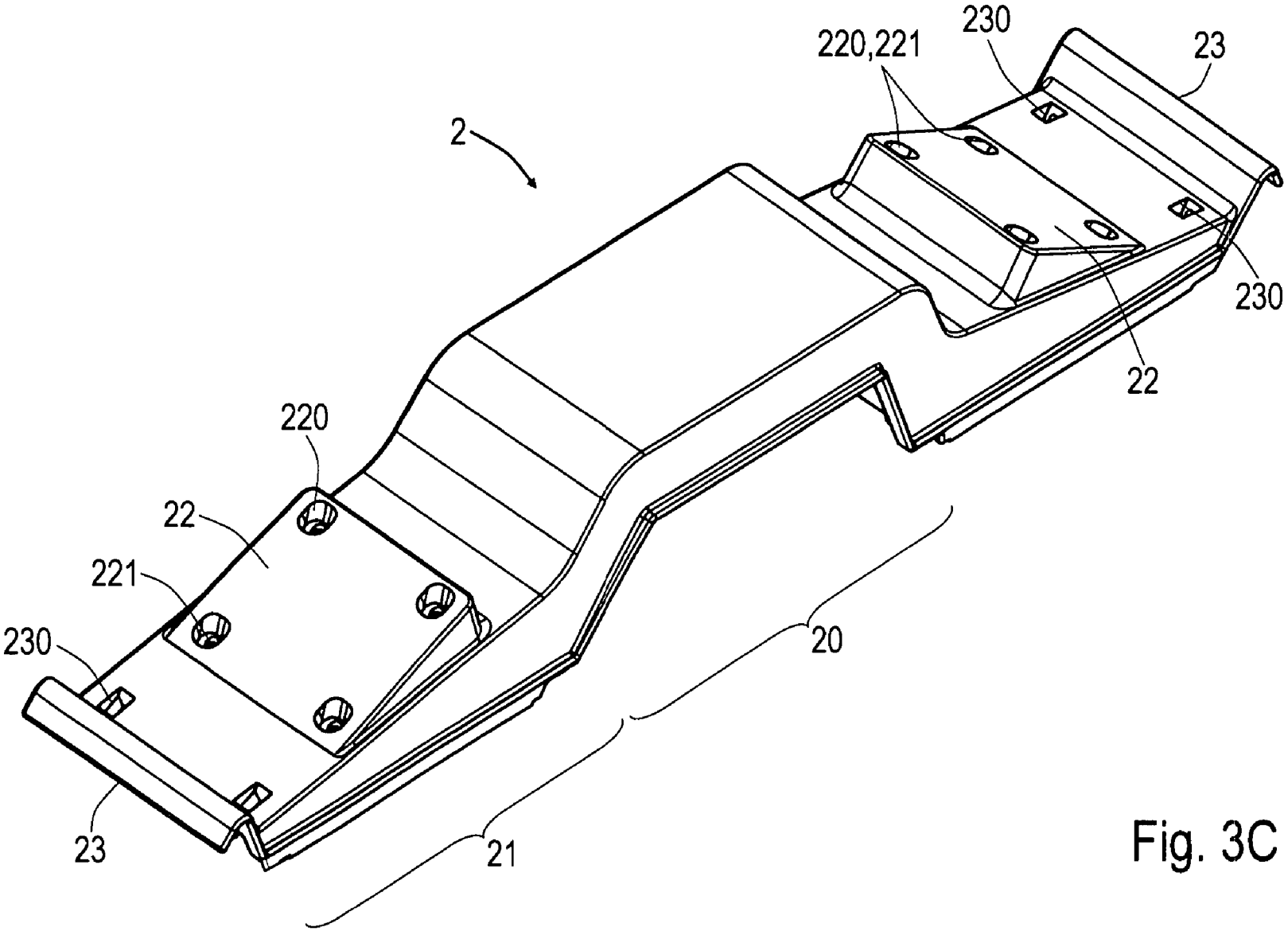
Figure 4:
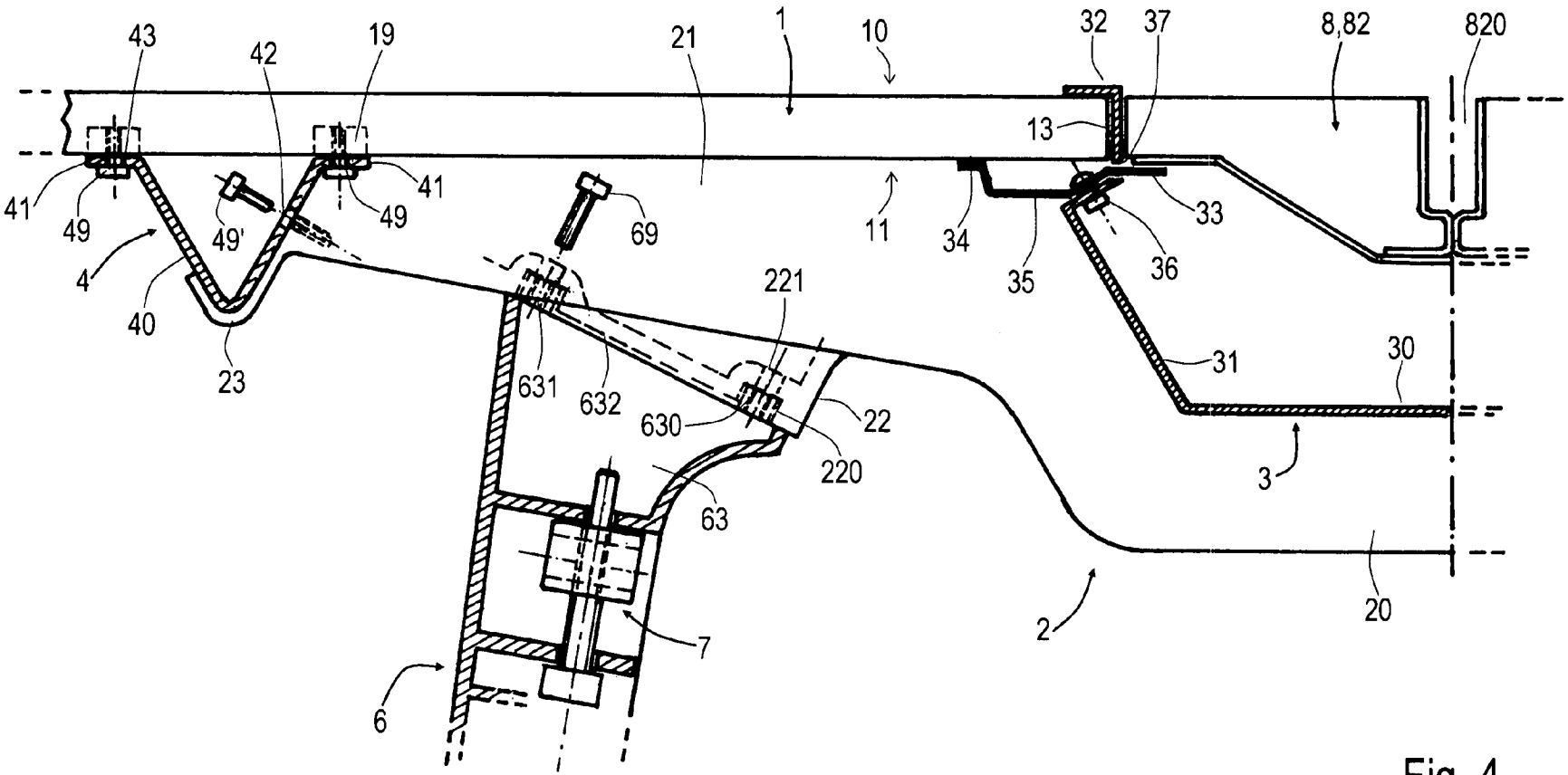
Figure 5A:
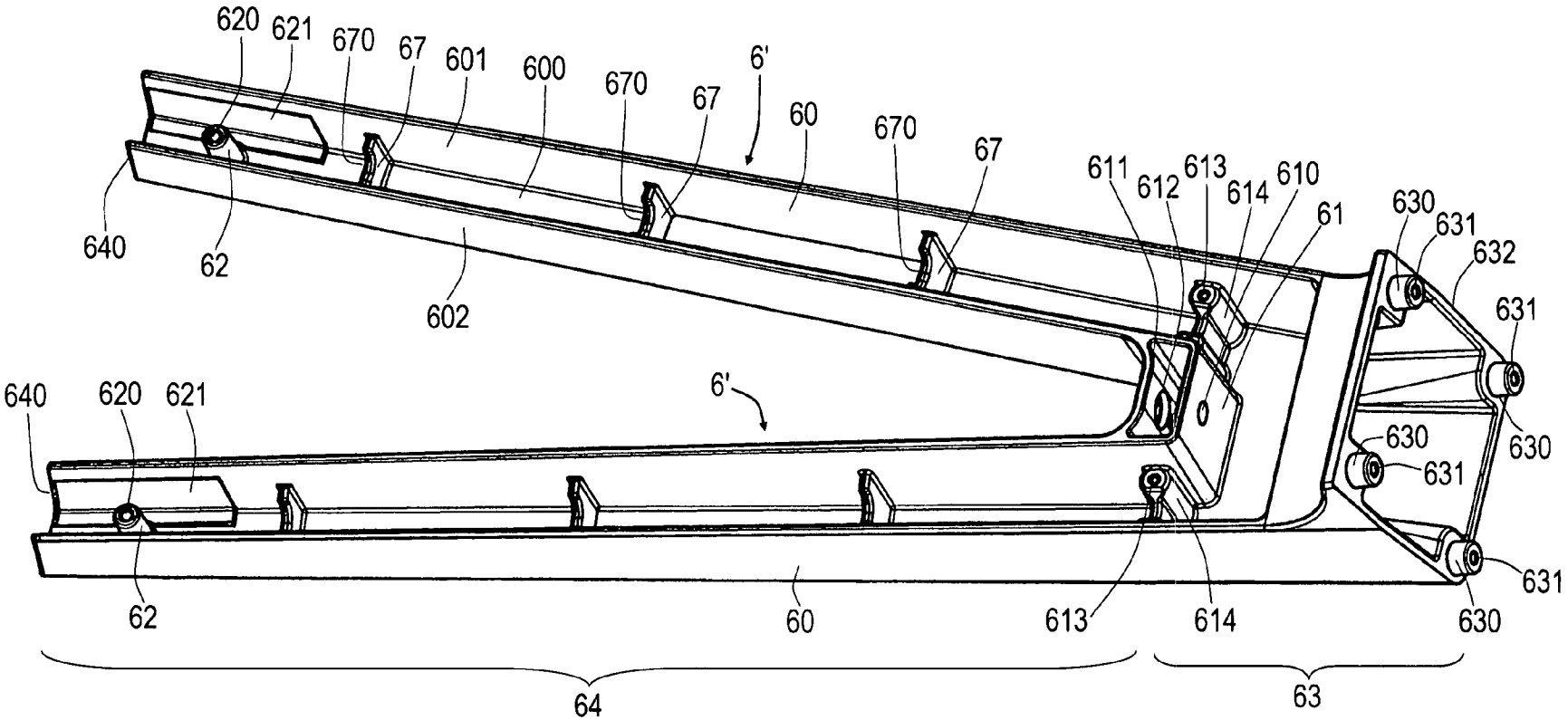
Figure 5B:
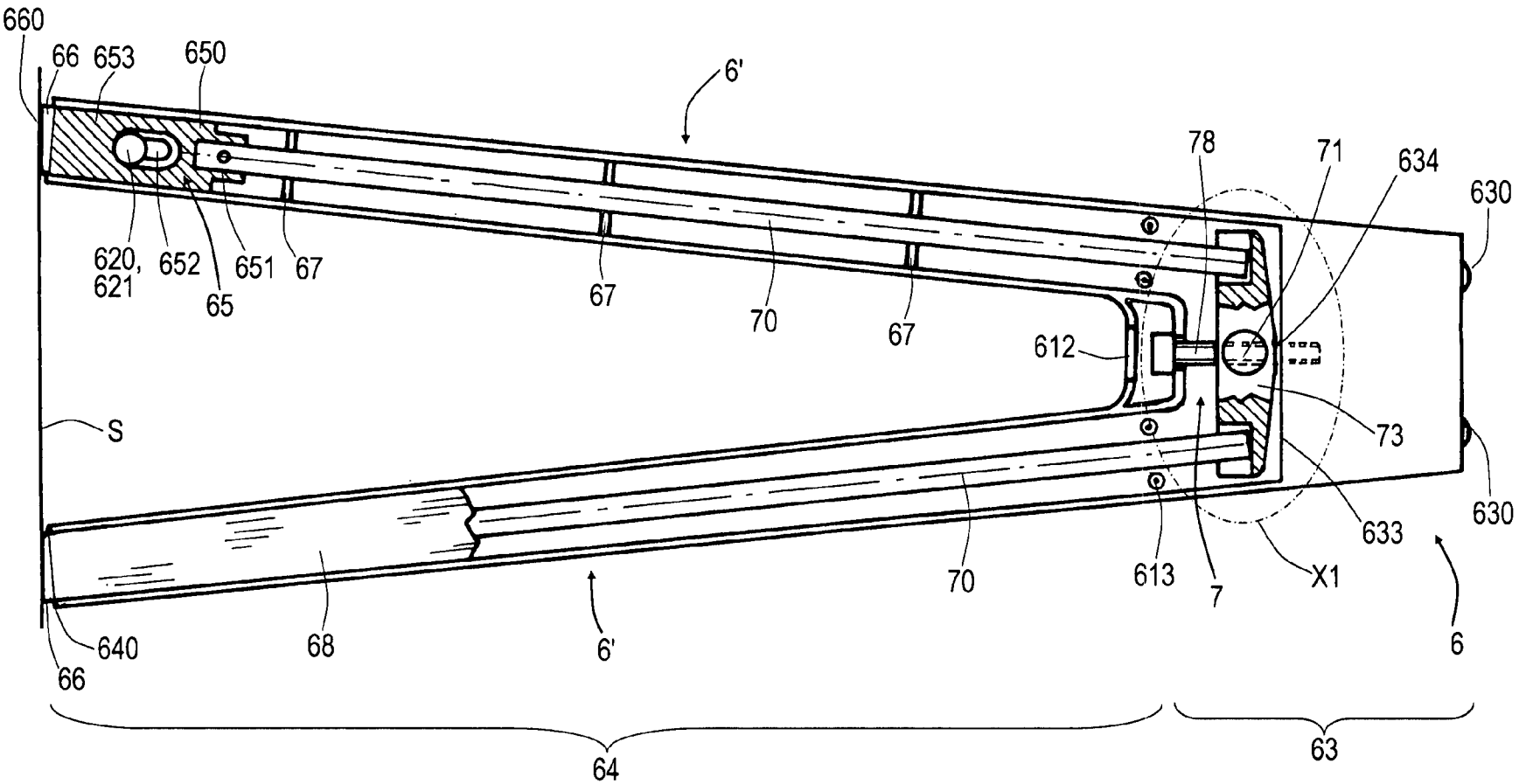
Figure 5C:
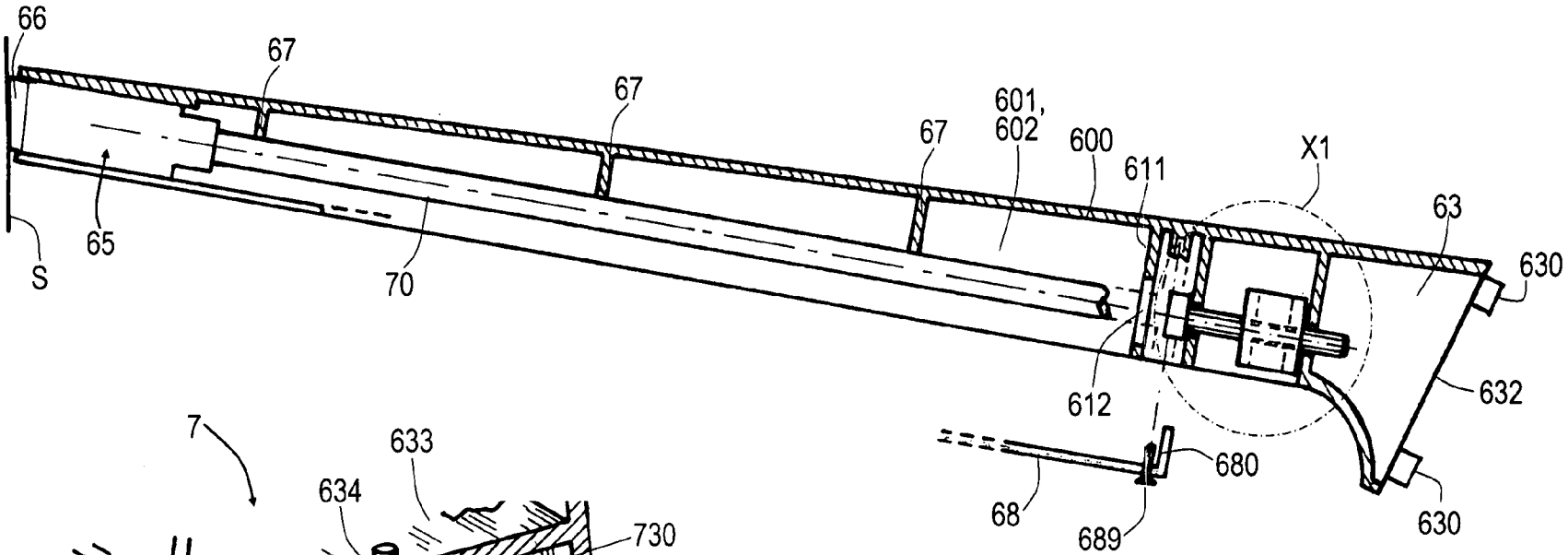
Figure 5D:
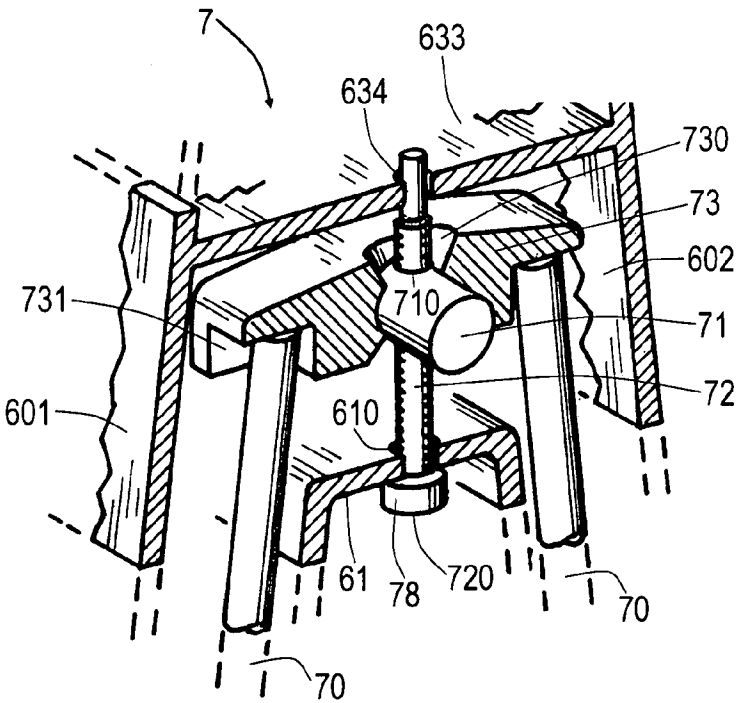
Figures 5E, 5F, 5G:
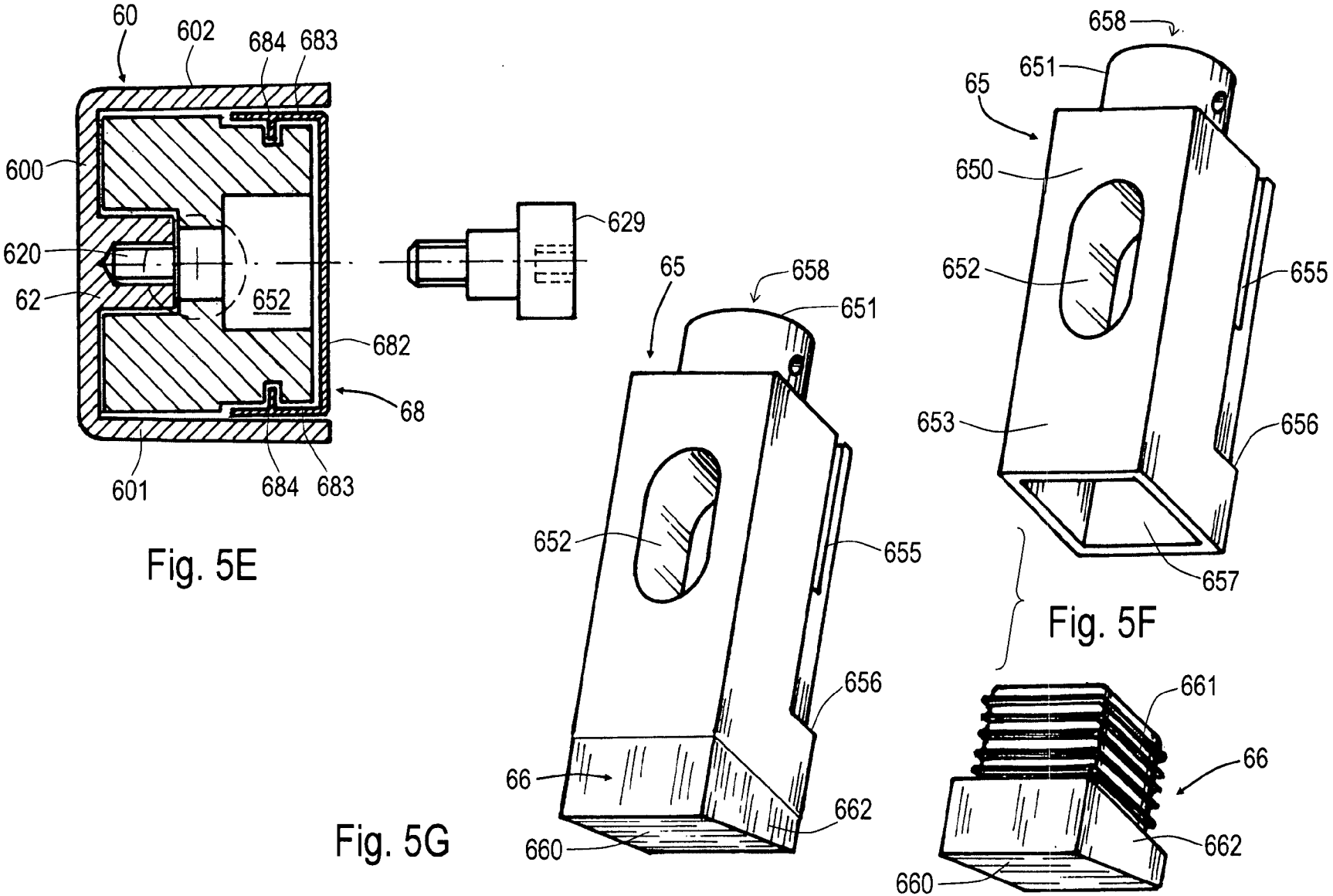
Figure 6A:
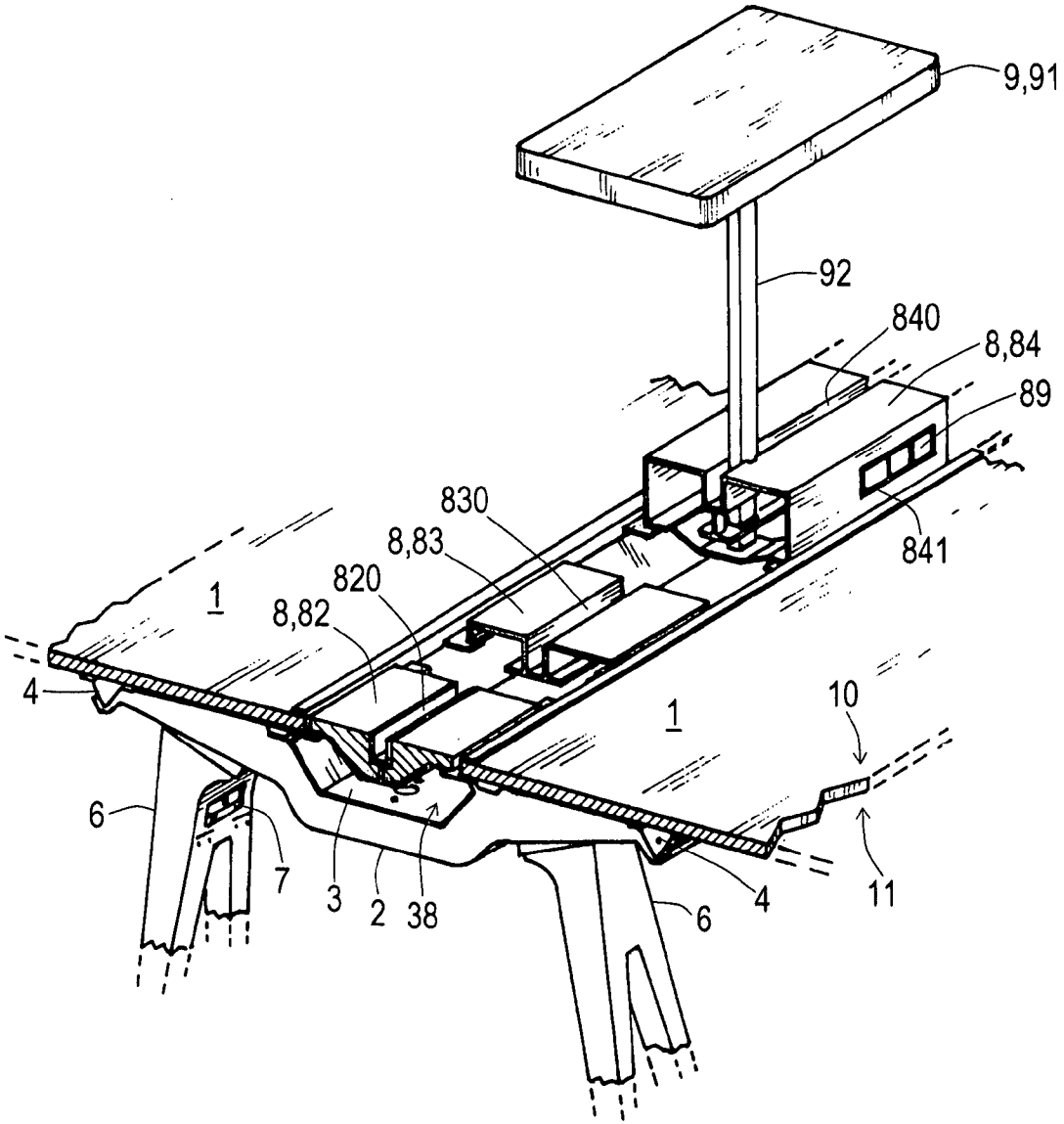
Figure 6B:
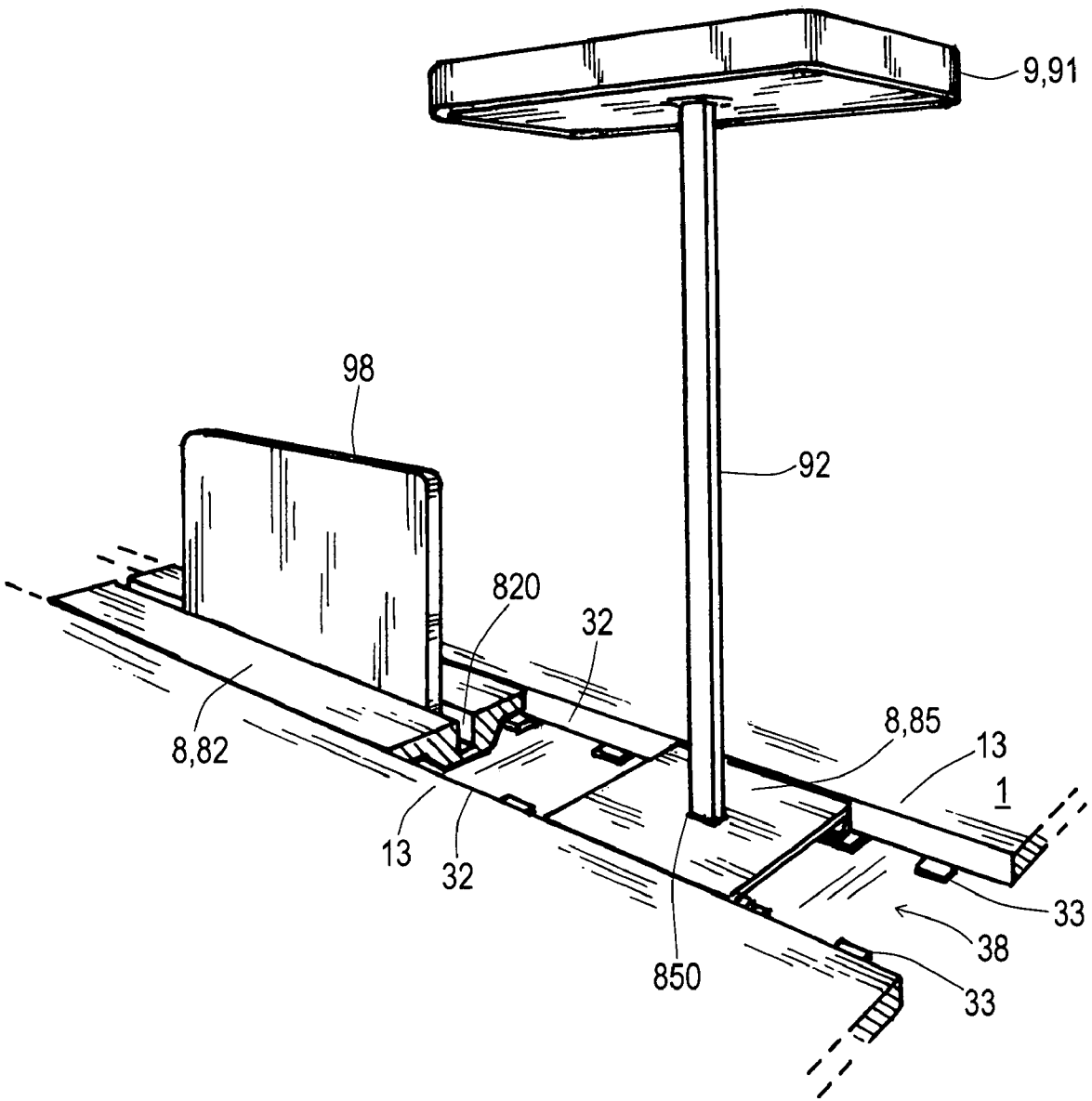
Figure 6C:
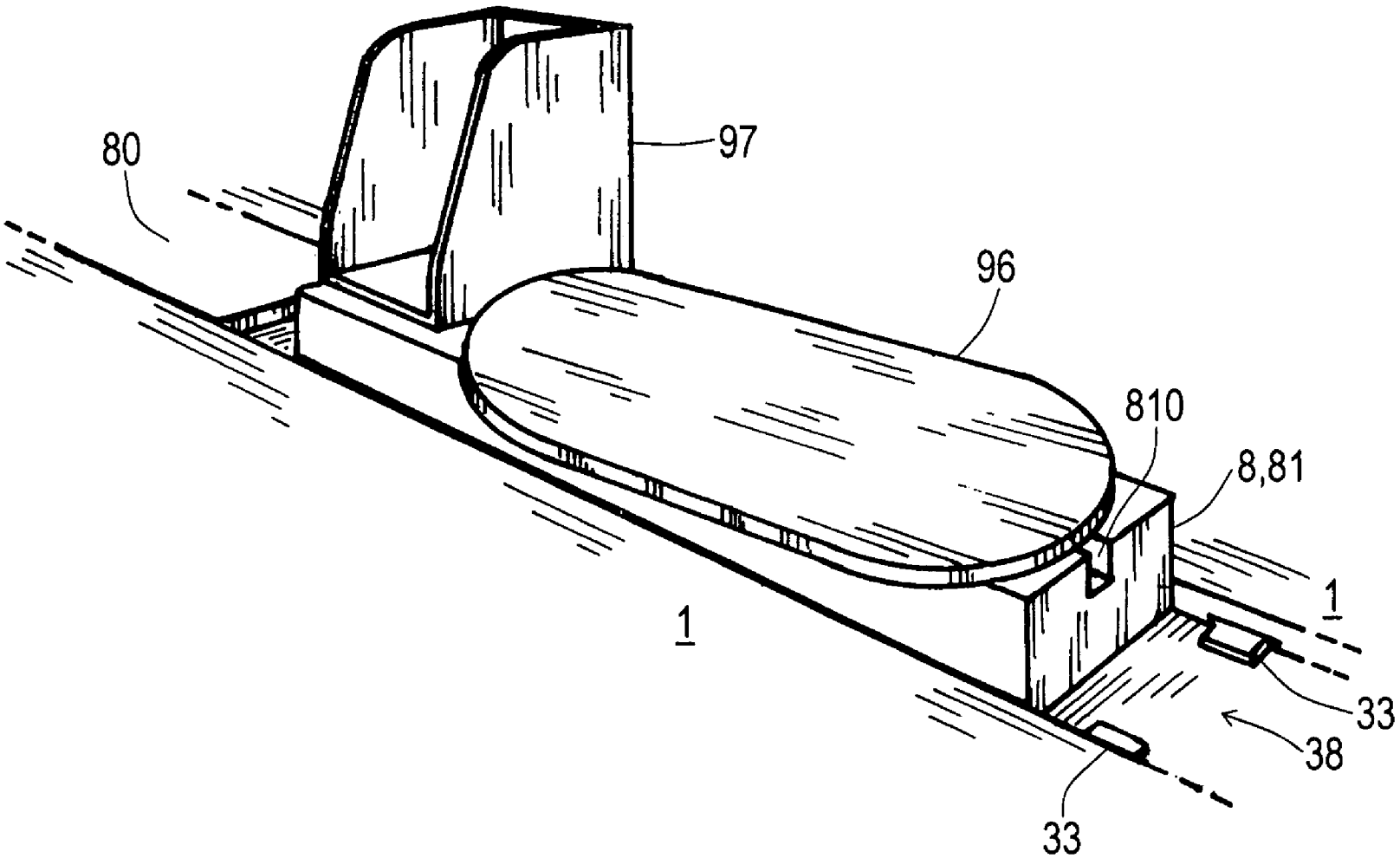
Figure 7:
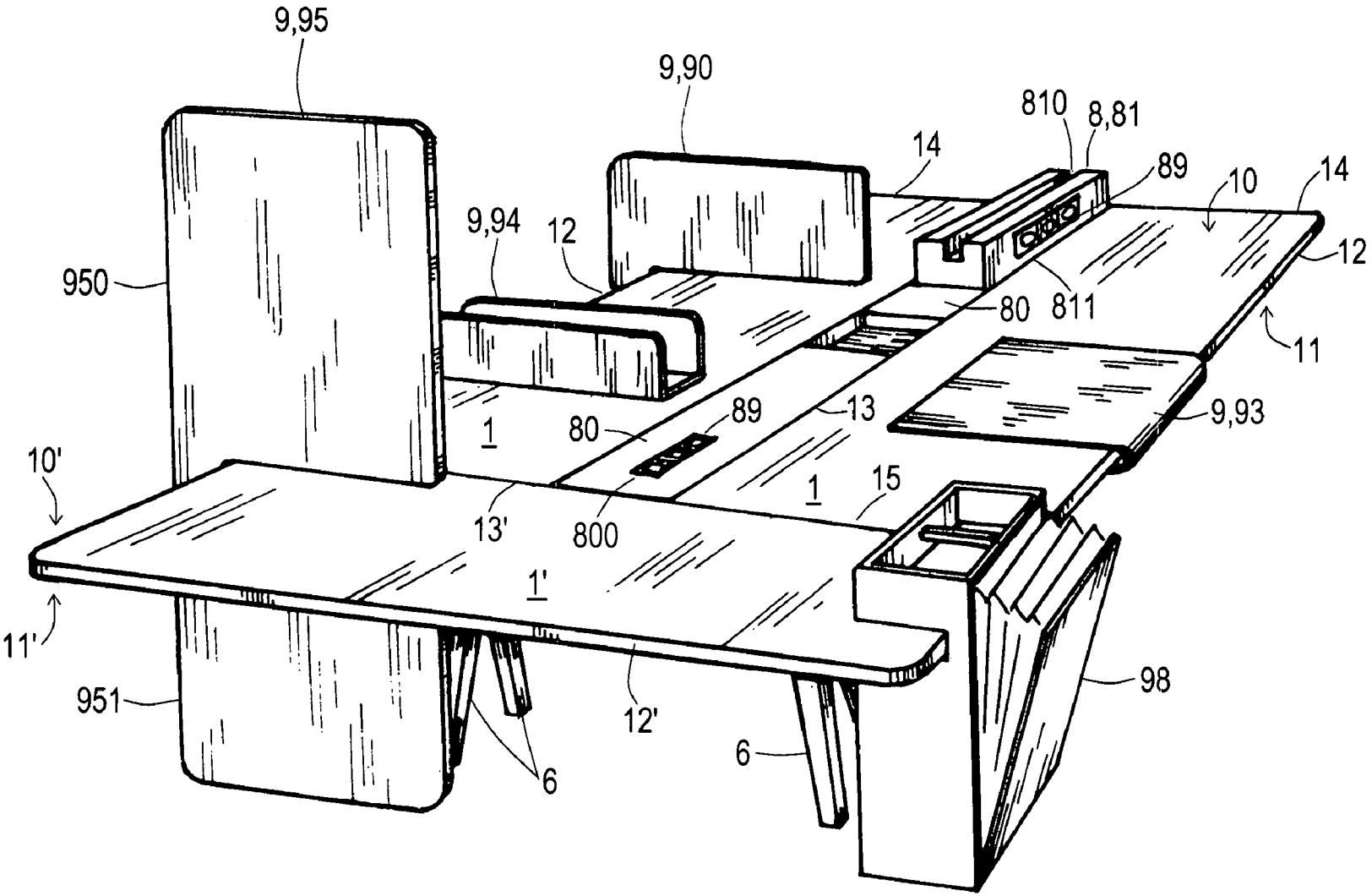
Figure 9A:
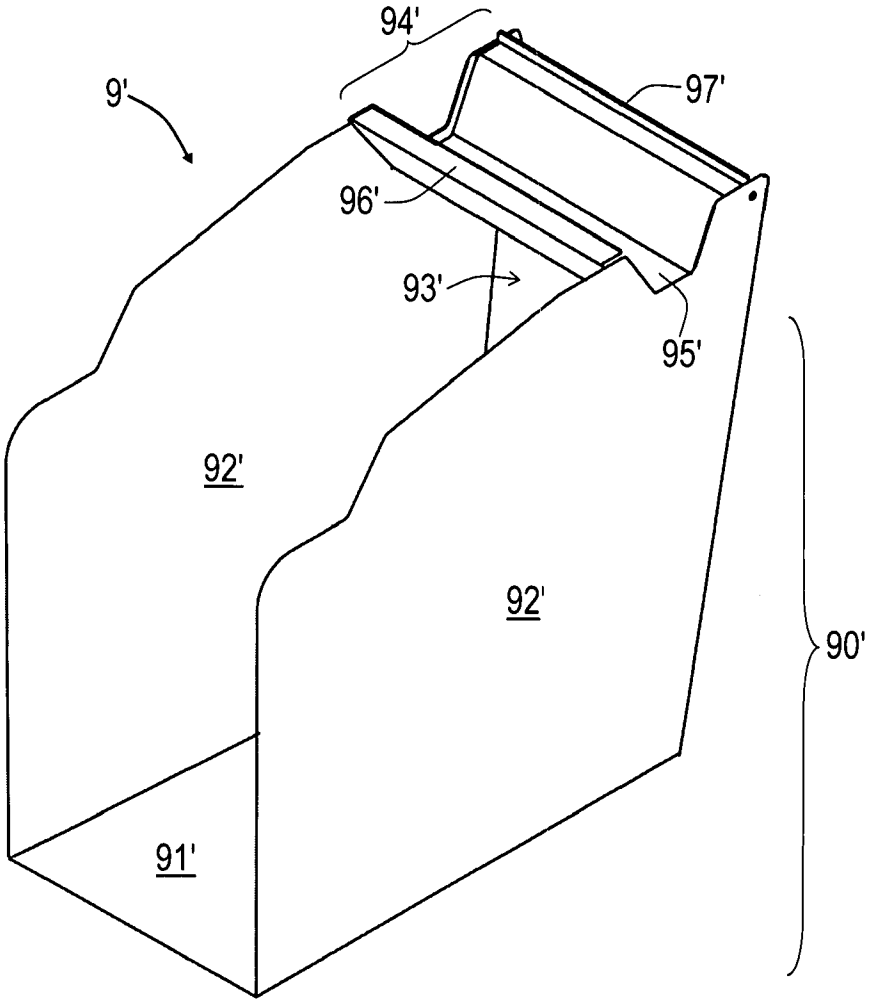
Figure 8:
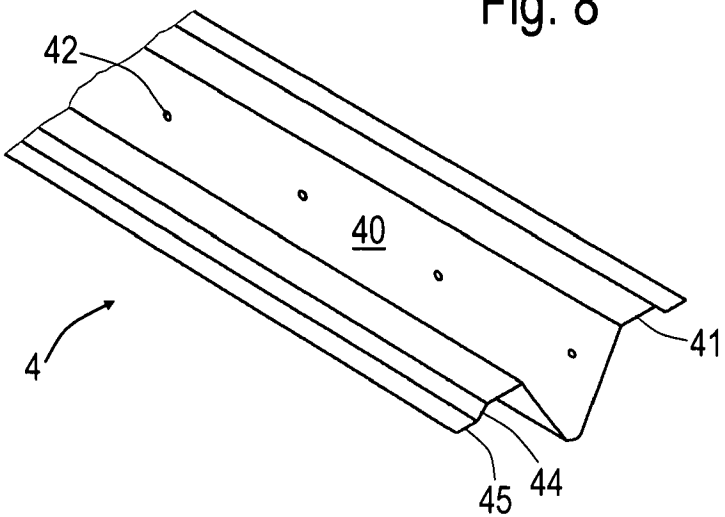
Figure 11D:
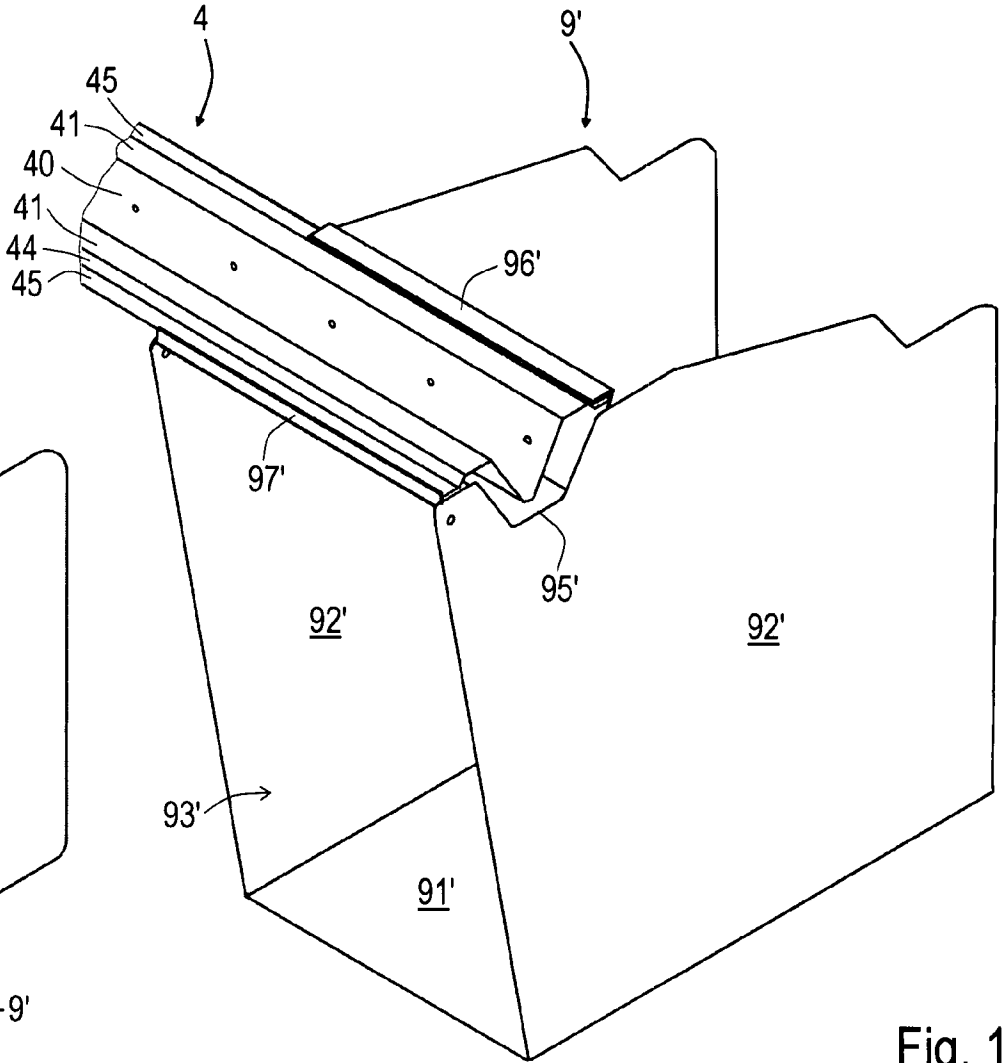
Figure 9B:
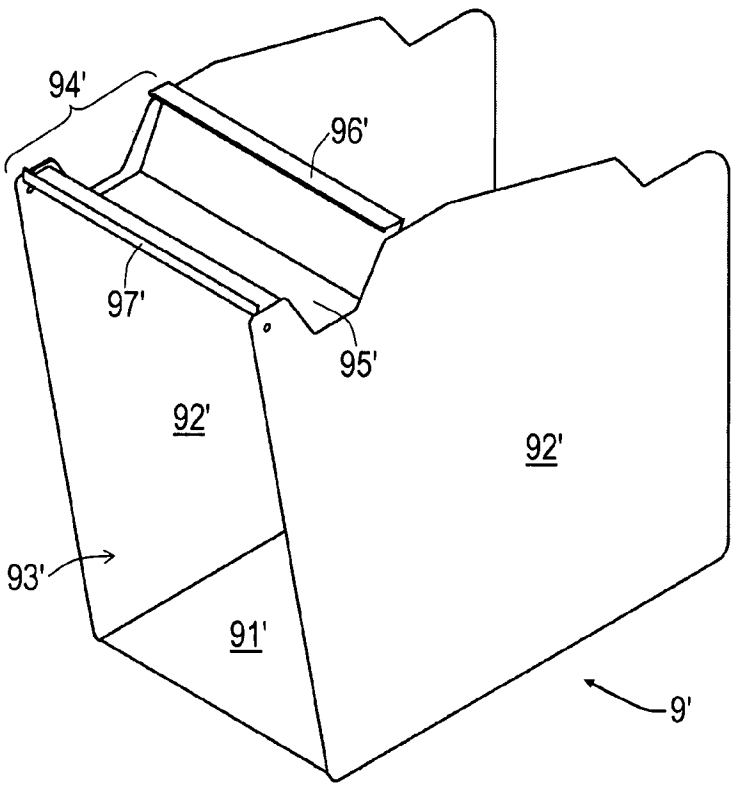
Figure 10:
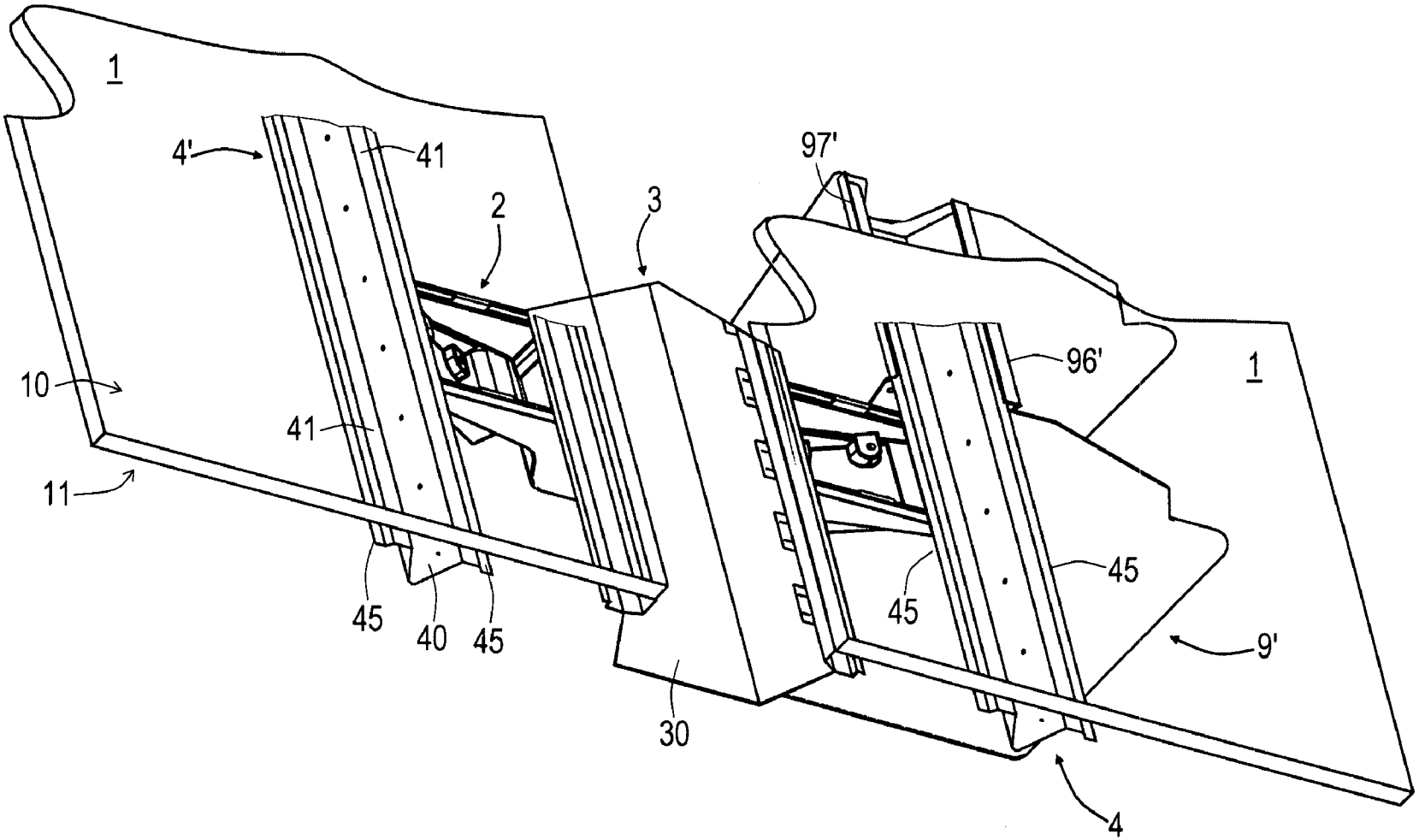
Figure 11A:
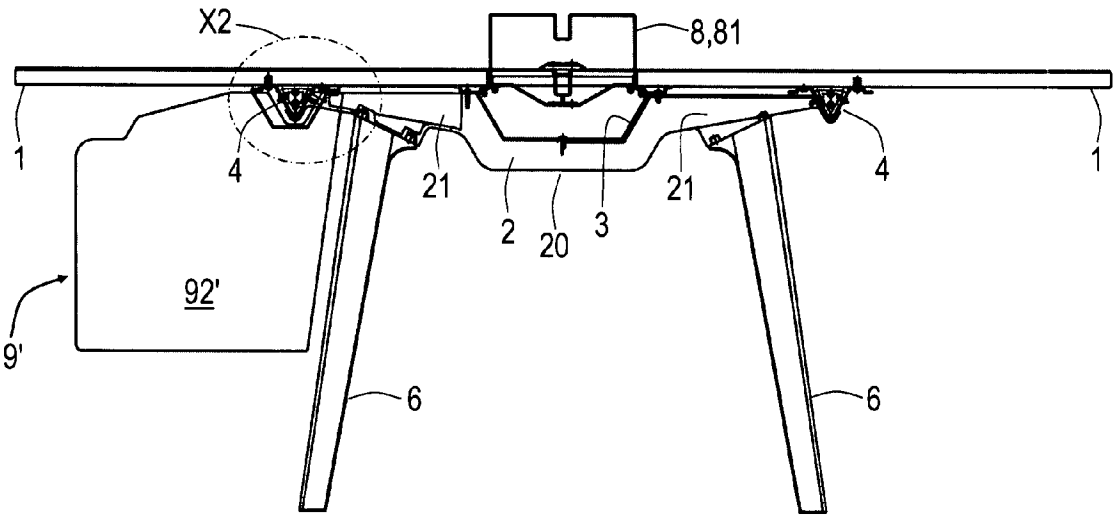
Figure 11C:
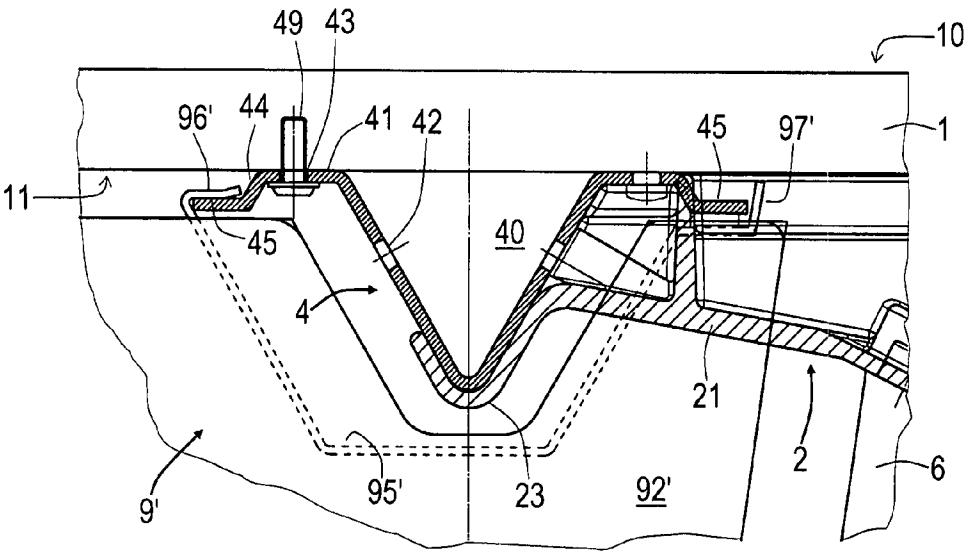
Figure 11B:
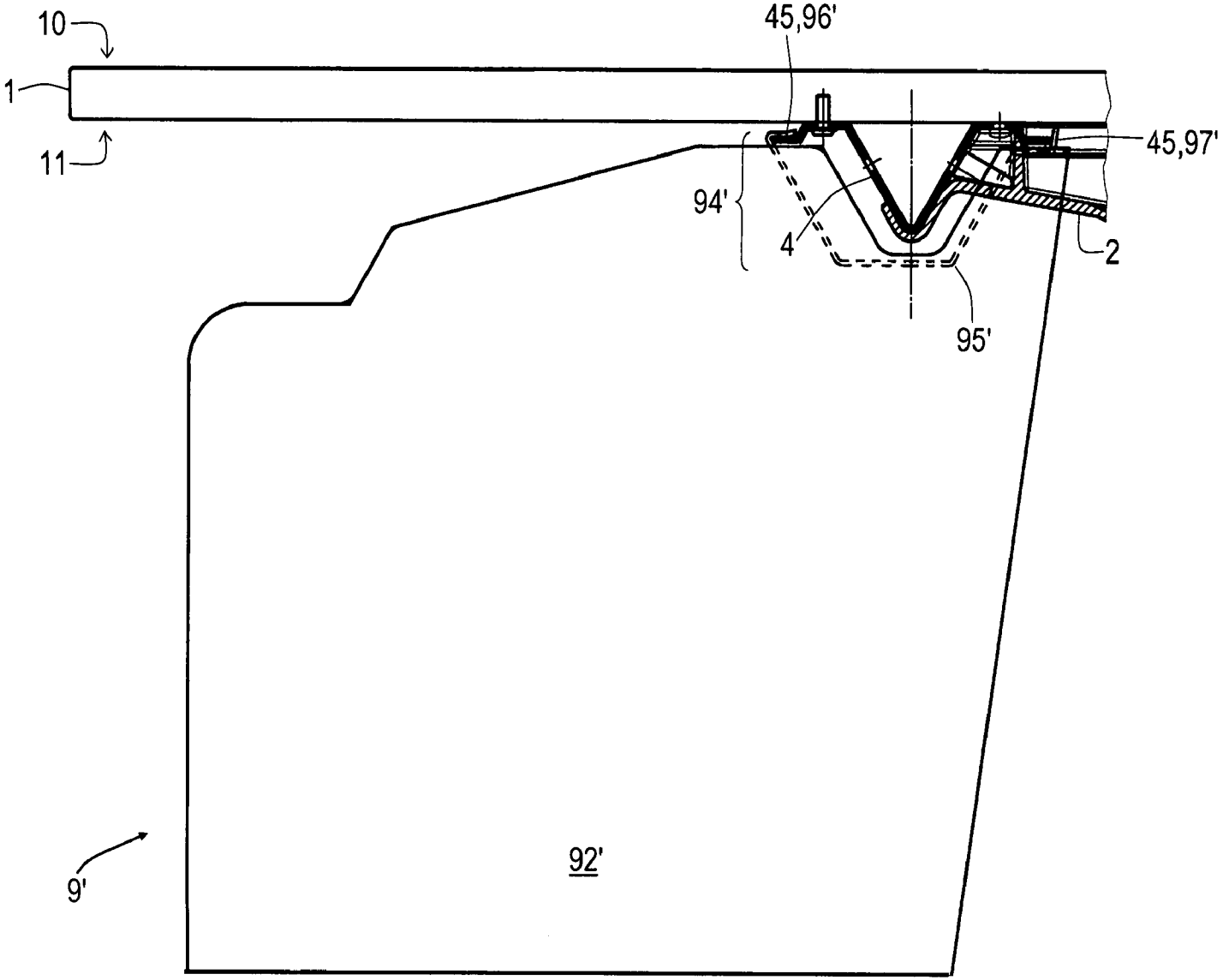

In the drawings:

FIG. 1A—shows a table according to the invention, with extensions indicated, in a front view of a longitudinal side;

FIG. 1B—shows the table according to FIG. 1A, without extensions, in an end side front view;

FIG. 2A—shows an end-side front view of the table, with a flat board as insert, in a perspective partial section;

FIG. 2B—shows the view according to FIG. 2A, with a block as insert;

FIG. 2C—shows approximately the view according to FIG. 2A, with the extension placed close to it, in a perspective partial section;

FIG. 3A—shows a transverse support from FIG. 1B in a perspective plan view;

FIG. 3B—shows the transverse support according to FIG. 3A, in a changed perspective plan;

FIG. 3C—shows the transverse support according to FIG. 3A, in perspective view from below;

FIG. 4—shows the head of a leg attached to the transverse support, in a partial vertical section;

FIG. 5A—shows a leg, in a perspective overall view;

FIG. 5B—shows the leg according to FIG. 5A, in a frontal, vertical partial section;

FIG. 5C—shows the leg according to FIG. 5A, in a lateral, vertical partial section through a leg;

FIG. 5D—shows the detail X1 from FIGS. 5B and 5C as an enlargement, in a vertical partial section;

FIG. 5E—shows an enlarged horizontal section in the region of the coupling element in FIG. 5B;

FIG. 5F—shows the coupling element from FIGS. 5B and 5E with a base element placed close to it;

FIG. 5G—shows the coupling element and the base element according to FIG. 5F, joined together;

FIG. 6A—shows the view according to FIG. 2A, with three different inserts;

FIG. 6B—shows further alternatives of inserts together with structures;

FIG. 6C—shows the block from FIG. 2A as insert, together with structures;

FIG. 7—shows the extended table according to FIG. 2C, fitted with various inserts and structures, in a perspective view;

FIG. 8—shows a side strut of the second version, in a perspective view;

FIG. 9A—shows a container for fitting below the table, in a perspective front view;

FIG. 9B—shows the container according to FIG. 9A, in a perspective rear view;

FIG. 10—shows the arrangement of tabletops, transverse support, channel and side struts of the second version according to FIG. 8, in a transparent perspective view;

FIG. 11A—shows the table in the version according to FIG. 2B, with the side struts of the second version according to FIG. 8 and fitted container according to FIG. 9A, in an end-side front view;

FIG. 11B—shows the left-side of the arrangement according to FIG. 11A, in an enlarged illustration;

FIG. 11C—shows the detail X2 from FIG. 11A as an enlargement, in a vertical partial section; and FIG. 11D—shows a schematic illustration of the engagement of the container according to FIG. 9A in a side strut of the second version according to FIG. 5A, in a perspective view.

EXEMPLARY EMBODIMENTS

The detailed description of exemplary embodiments for the table according to the invention takes place below with reference to the accompanying drawings.

The following statement applies to the entire further description. If reference numerals are contained in a figure for the purpose of graphical unambiguity, but are not explained in the immediately associated text of the description, reference is made to where they have been mentioned in the preceding descriptions of the figures. In the interest of clarity, the repeated designation of components in the following figures is generally omitted if it can be seen unambiguously in the drawings that they involve "repeating" components.

FIGS. 1A to 3C

The table has a substructure, which is supported by legs 6 placed on a standing surface S, and two tabletops 1,1, with their topside 10 and underside 11, which are placed opposite each other onto the substructure. The substructure first of all comprises at least two transverse supports 2 which in each case in the center have a lowered channel zone 20 from which extend in opposite directions respective extension arms 21 which have a leg mount 22 for the fitting-on of the legs 6 and a strut mount 23. The transverse supports 2 are arranged spaced apart from each other in parallel and transversely with respect to the longitudinal extent of the table. The substructure furthermore includes a channel 3 which, in the longitudinal extent of the table, is secured on the at least two transverse supports 2, thus producing a double T in top view. Finally, the substructure is completed with respective side struts 4 of the first version which, in the longitudinal extent of the table, bridge the strut mounts 23 of the transverse supports 2, which strut mounts are placed in each case on one side of the table. In the free space above the channel zone 20 and therefore between the mutually opposite tabletops 1,1 an insert 8, here in the simplest, board-shaped form 80, is placed on the same plane (see FIG. 2A). A modified insert 8,81 is raised in a block-shaped manner, has an insertion groove 810 on the top surface and a clearance 811 laterally for the insertion of a socket unit 89 (see FIG. 2B).

The channel 3 is upwardly open and has the preferred, trapezoidal cross section; however, it could also be of U-shaped, V-shaped or rectangular cross section. The channel zone 20 in the transverse supports 2 is of complementary design to the cross section of the channel 3. The double legs 6;6',6' are attached to the leg mounts 22 of the transverse supports 2 in such a manner that the two legs 6',6' define a plane which points in the longitudinal direction of the table. The leg portions 64 of two legs 6;6',6' arranged opposite each other are preferably spread further apart than the head portions 63 thereof. A height-leveling device 7 which acts on both legs 6',6' is accommodated in the legs 6. The channel 3 is provided for table lengths of preferably greater than 2.50 m, with the transverse supports 2 with the legs 6 attached thereto only having to be provided in the region of the front ends of the table in each case, i.e. it being possible to dispense with transverse supports 2 and legs 6 inserted in between. Only in the case of relatively large table dimensions is provision made to add at least one further transverse support 2 and legs 6. The channel 3 having the relatively large-volume channel space 38 has an average width which is a multiple of the height, and preferably consists of sheet metal which is, e.g., 2.0 mm thick.

On both sides of the channel 3, on the plane of the tabletops 1,1 to be placed on, a respective surround 32 is provided for fixing the tabletops 1 at their longitudinal inner edges 13, the surround preferably being in the form of an angled stop with an edge which engages over it at the top and under which the longitudinal inner edges 13 can be slid. On the other hand, the tabletops 1,1 are fixed in the vicinity of their longitudinal outer edges 12 to the side struts 4 of the first version. The strut mounts 23 on the transverse supports 2 are of upwardly open V-profile, and also the side struts 4 of the first version are essentially an upwardly open V-profile 40 which, at least with the pointed, lower region, find space with a suitable shape in the strut mounts 23. The V-profile 40 has at the top on both sides horizontal chamfered portions 41 which are used as a support for and securing of the tabletops 1. The fastening between the side struts 4 of the first version and the transverse supports 2 and between the side struts 4 and the tabletops 1 is preferably realized in a spot-type manner by means of screws 49',49. The channel 3 is screwed by means of screw holes 300 in its base to internal threaded bores 200 in the lowered channel zone 20.

On both sides of the channel 3, below the plane of the tabletops 1,1 to be placed on, a respective supporting edge 34, which points away from the channel 3, is provided for supporting and fixing the tabletops 1,1 at their longitudinal inner edges 13. Mounted upstream of the outer supporting edge 34 is a screw edge 35 which is lowered in the direction of the oblique side surface 31 and through the holes 350 of which the channel 3 can additionally be screwed on both sides of the transverse support 2 to the inner threaded bores 210. Also on both sides of the channel 3, again below the plane of the inserts 8 which are to be placed on, set-down surfaces 33, which point into the channel 3, are provided in each case, in order to support said inserts. The supporting edges 34 and the set-down surfaces 33 are formed by a profiled material strip fixed on the channel 3, and the surround 32 is a continuation of the wall of the channel 3. Optional installation apertures 301 are provided in the channel 3, preferably in the base surface 30 thereof, as a means of access for lines and/or installations.

The table can be enlarged in the longitudinal extent by means of tabletop extensions 1',1' which can be attached laterally, these extensions being supported by strut extensions 5 and bridge elements 5' (see FIG. 2C). The bridge struts 5' are fastened, on the one hand, in the respectively aligned side strut 4 and, on the other hand, in the strut extensions 5 arranged on the underside 11'. The screw holes 42,52,52', which are present in each case in the side strut 4 of the first version, in the strut extension 5 and in the bridge strut 5', are used for this. By means of screw holes 43 in the horizontal supports 41 of the side strut 4, the fastening to the tabletop underside 11 takes place by means of screws 49, the screws 49 engaging in screw inserts 19 which have been pressed in. Situated in the vicinity of the strut mounts 23 on the transverse support 2 are internal threaded bores 230 which open obliquely and are used for fixing the side struts 4 of the first version on the transverse supports 2 by means of screws 49'.

FIGS. 4 to 5G

The legs 6, which can be fitted on the table, having the two legs 6',6' in each case have, on their head portion 63, a flange edge 632 which, in the fitted-on state, is attached on the leg mount 22 on the transverse support 2 from the underside. The double legs 6;6',6' are attached to the table in such a manner that the two legs 6',6' define a plane which points in the longitudinal direction of the table. The screwing between the leg 6 and the respective leg mount 22 on the transverse support 2 now takes place by means of screws 69 which engage from the topside of the transverse support 2 through the bores 221 present therein into the screw necks 630 having the internal threaded bores 631 provided therein.

In the case of the double leg 6, one leg portion 64 extends from the head portion 63 to the standing surface S, two legs 6',6' emerging from the head portion 63, said legs spreading apart and being formed in each case by a leg profile 60. A height-leveling device 7 which acts on both legs 6',6' is contained in each leg 6. There emerges from each lower leg end 640,640 a base element 66 which is arranged displacably and can be adjusted by means of the height-leveling device 7. The height-leveling device 7 comprises an adjusting screw 78 which is accessible from the outside, is arranged in the head portion 63 and carries along a rotating spindle 71 on which a rocker element 73 is mounted in an oscillating manner. In the leg portion 64 of the two legs 6',6' spread apart, a respectively axially displaceable slide rod 70,70 is mounted in the respective leg profile 60,60 of said legs. In this case, the slide rods 70,70 lie in ribs 67 having semicircular clearances 670 for receiving the side rods 70,70. The upper ends of the two slide rods 70,70 butt in the region of lateral clearances 731 against the rocker element 73 which determines, by means of its set height position, the push-in depth of the slide rods 70,70. During the tilting of the rocker element 73, the clearances 731 provide free space for the upper ends of the slide rods 70,70. An upwardly widening clearance 730 in the rocker element 73 provides free space for the threaded pin 72 during the angling of the rocker element 73.

The adjusting screw 78 standing vertically between the uppermost head plate 633 and a transverse rib 61 situated below it reaches with its threaded pin 72 into an internal threaded bore 710 passing through the rotating spindle 71. In this case, the adjusting screw 78 is inserted in a through hole 610 in the transverse rib 61 and in a through hole 634 in the head plate 633. In the head 720 of the adjusting screw 78 there is an internal contour which is accessible from the outside through the base rib 611 with the through hole 612. Provided in the head portion 63 on both sides of the transverse rib and base rib 61,611 are intermediate ribs 614 and threaded eyes 613 at which a leg covering 68,68 for each leg 6',6' can be screwed on. At the top, the individual leg cover 68 is fastened to the head portion 63 by means of a screw 689. At the bottom, the slide rods 70,70 act on the respective base element 66,66. The leg profile 60 is, in principle, of U-shaped cross section with a rear wall 600 and the two side walls 601,602 which are adjacent to the latter and lie opposite each other. The leg covering 68,68 closes the open side of the leg profile 60, which side lies opposite the rear wall 600.

By means of the adjusting screw 78, via the rocker element 73, the slide rods 70, 70, which are mounted in an axially displaceable manner in each case in the leg portion 64, namely in the leg profile 60, and act at the bottom in each case on the associated base element 66, are leveled in their height position. The base element 66 has a cross section which corresponds in principle to the clear internal cross section of the leg profile 60 at the lower leg end 640. The set-down surface 660, which is situated right at the bottom of the base element 66, is an oblique plane which compensates for the oblique position of the leg portion 64 with respect to the standing surface S. A coupling element 65, to which the slide rod 70 is fastened at the top and the base element 76 is fastened at the bottom, is fitted between the lower end of each slide rod 70 and the base element 66. As an alternative, the base element 66 and the coupling element 65 could form an integral constructional unit. The coupling element 65, which is separate or is connected integrally to the base element 66, is arranged in the leg profile 60 in a manner such that it can be displaced axially over a defined region. The coupling element 65 has, on its upper part 650, a receiving neck 651 with an upwardly open blind hole 658 in which the slide rod 70 is fixedly inserted. The lower part 653 of the coupling element 65 has a downwardly open, axial blind hole 654 in which the pin portion 661 of the base element 66 is inserted. The outer part 662 with the oblique set-down surface 660 is attached to the pin portion 661.

In the region of the lower leg end, a screw bearing 62 having the internal threaded bore 620 present in it extends from the rear wall 600. The screw bearing 62 projects into an elongated hole 652 present in the coupling element 65, so that the coupling element 65 is guided on the screw bearing 62 with a movement clearance which, in principle, is vertical. For this purpose, a screw 629 reaches through the elongated hole 652 into the internal threaded bore 620. In order to secure the leg covering 68, the front panel of which extends as far as the lower leg end, there are undercut sliding grooves 655 on the coupling element 65 in which hooks 684 on the side limbs 683 of the latched-on leg covering 68 engage.

At the bottom of the coupling element 65 there is a set-down edge 656 and a passage 657, the latter being used for the insertion of the pin portion 661 of the base element 66. This enables the coupling element 65 to move upward or downward on the fixed leg covering 68 during adjustment of the height-leveling means 7. The base elements 66 protrude out of the lower leg ends 640 and are placed with their oblique set-down surfaces 660 on the adjusting surface S. The coupling elements 65 are additionally guided in inner clearances 621 on the legs 6',6'.

FIGS. 6A to 7

Differently configured inserts 8;80,81,82,83,84,85 which can have at least one aperture 800,811,841,850 and/or a groove 810,820,830,840 can be placed over the channel 3. The aperture 800,811,841,850 is used for receiving a socket unit 89 or for the insertion of a support 92 which, for example, bears a light 91. Structures can be inserted into the groove 810,820,830,840, for example in the form of a possibly axially displaceable and/or rotatable, horizontal panel 96, a possibly axially displaceable and/or rotatable book/file support 97 or a vertically standing screen 98. Various structures 9 are provided for arrangement at and/or on the particular tabletop 1,1, which structures can easily be positioned and displaced or removed again, for example by sliding over the table edge 12. Such structures 9 are, for example:

- a half-height, panel-shaped side screen 90 which forms a vertical delimitation on the table from the adjacent position and has, for example, an incision for securing it;
- a placemat 93 which lies on the tabletop 1, therefore defines a workplace and has, for example, a bent-over edge at the front for securing it;
- a utensil tray or file/book support 94 which sits on the tabletop 1 and has, for example, a bent-over edge at the front for securing it;
- a high, panel-shaped side screen 95 with an upper part 950 standing above the tabletop 1 and a lower part 951 which forms a vertical delimitation into the vicinity of the standing surface S, the side screen 95 being provided, for example, with an incision for securing it; and
- a collecting container 98 which extends essentially below the particular tabletop 1 and has, for example, an incision for securing it.

FIG. 8

The side strut 4 of the second version differs from the first version (see, for example, FIG. 4) only by the fact that a respective oblique transition 44 which ends in a support edge 45 is attached to the flat chamfered portions 41 present on both sides. The support edge 45 lies, as observed in the horizontal plane, in an offset manner below the chamfered portions 41. Otherwise, the side strut 4 of the second version likewise has the V-profile 40 with the screw holes 42 and the screw holes 43 in the chamfered portions 41.

FIGS. 9A and 9B

In particular for setting the CPU of a computer below the tabletop, but raised from the floor, a container 9' is provided having a useful space 90' and an adaptor region 94', which is arranged right at the top of the rear side 93' and is intended for fitting into the side strut 4 of the second version. The useful space 90' is formed by the base 91' and the two side walls 92',92' extending upward therefrom, and is therefore open to the front, top and rear for access to the inserted CPU. Above the open rear side 93' of the container 9', the adaptor region 94' bridges the two side walls 92',92' and has a channel-like depression 95', which runs longitudinally and extends over the width of the container 9', passing through it. At the top of the depression 95', facing the rear side 93', there is an upwardly directed stop edge 97', and, running parallel to the latter on the depression 95', facing the front side, is a bent-over portion 96' which is inclined toward the depression 95'.

FIGS. 10 to 11D

This sequence of figures illustrates the arrangement of the side struts 4 of the second version below the tabletops 1 and the fitting of the container 9' into the side struts 4. As previously described, the two side struts 4 are supported by means of their V-profile 40 by the strut mounts 23 of the transverse support 2 and extend at a distance on both sides along the channel 3 arranged in the center. The tabletops 1 rest with their undersides 11 on the chamfered portions 41 of the side struts 4 and are secured by means of screws 49, which engage through screw holes 43 into the tabletops 1. Because of the offset of the support edges 45 downward—in relation to the chamfered portions 41—there arise on the left and right of the side struts 4 between the underside 11 of the tabletops 1 and the support edges 45 respective gaps into which the bent-over portion 96' of the container 9 can be fitted.

In the fitted state, the bent-over portion 96' engages over the support edge 45 in the region of the selected positioning of the container 9', and the V-profile 40 projects together with the strut mount 23 into the depression 95'. The suspension and position of the center of gravity of the container 9' cause it to be aligned with respect to the center of the table and cause the stop edge 97' to be abutted against the second support edge 45 which lies opposite the first support edge which is covered by the bent-over portion 96'. As a result, a container 9', loaded, for example, with a CPU, experiences a reinforced tendency for alignment with respect to the center of the table, so that the container 9' together with its contents is provided in a stable manner, but such that it can be displaced and removed simply and rapidly, below the tabletop. The rapid positioning of the container 9' and its displaceability along the side strut 4 enable the user to easily provide himself with leg room, and have the further advantage of being accommodated in a manner raised from the floor. The uncomplicated removal of the container 9' and the accessibility via three open sides facilitate the service at the CPU. The symmetrical geometry of the side strut 4 means that attention does not have to be paid during installation to how the two flanks come to lie toward the center or side of the table.

The invention claimed is:

1. A table, comprising a substructure, which is supported by legs (6) placed on a standing surface (S), and a tabletop (1) placed onto the substructure, wherein the substructure is formed from a) at least two transverse supports (2) which in each case in the center have a lowered channel zone (20) from which extend in opposite directions respective extension arms (21) which have a leg mount (22) for the fitting-on of the legs (6) and a strut mount (23), the at least two transverse supports (2) being arranged, spaced apart from each other in parallel, transversely with respect to the longitudinal extent of the table;

b) a channel (3) which, in the longitudinal extent of the table, is secured on the at least two transverse supports (2), thus producing a double T in top view, the channel (3) being upwardly open and having a U-shaped, V-shaped, rectangular, or a trapezoidal cross section, and the channel zone (20) in the transverse supports (2) being complementary to the cross section of the channel (3); and c) respective side struts (4) which, in the longitudinal extent of the table, bridge the strut mounts (23) of the transverse supports (2), which strut mounts are placed in each case on one side of the table, wherein the legs (6;6',6') are double legs and are attached to the leg mounts (22) of the transverse supports (2) in such a manner that the two legs (6',6') define a plane which points in the longitudinal direction of the table, the two legs (6;6',6') including leg portions (64) arranged opposite each other are spread further apart than their head portions (63), inserts (8) sized to be inserted over the area above the channel (3); and the tabletop (1) is provided in each case on both sides of the inserts (8).

2. A table, comprising a substructure, which is supported by legs (6) placed on a standing surface (S), and tabletops (1) placed onto the substructure, wherein the substructure is formed from at least two transverse supports (2) which in each case in the center have a lowered channel zone (20) from which extend in opposite directions respective extension arms (21) which have a leg mount (22) for the fitting-on of the legs (6) and a strut mount (23), the at least two transverse supports (2) being arranged, spaced apart from each other in parallel, transversely with respect to the longitudinal extent of the table;

a channel (3) which, in the longitudinal extent of the table, is secured on the at least two transverse supports (2), thus producing a double T in top view; and respective side struts (4) which, in the longitudinal extent of the table, bridge the strut mounts (23) of the transverse supports (2), which strut mounts are placed in each case on one side of the table wherein a) the legs (6;6',6') are double legs and are attached to the leg mounts (22) of the transverse supports (2) in such a manner that the two legs (6',6') define a plane which points in the longitudinal direction of the table; and b) the two legs (6;6',6') including leg portions (64) arranged opposite each other are spread further apart than their head portions (63);

c) inserts (8) sized to be inserted over the area above the channel (3); and d) the tabletops (1) provided on both sides of the inserts (8), the tabletops (1) including a first tabletop and a second tabletop.

3. The table as claimed in claim 2, wherein the channel (3)

a) is provided for table lengths greater than 250 cm, with the transverse supports (2) and the legs (6) having to be provided only in the region of the front ends of the table in each case;

b) has an average width which is a multiple of the height; and c) consists of sheet metal which is 2.0 mm thick.

4. The table as claimed in claim 3, wherein a) on both sides of the channel (3), on the plane of the tabletops (1) which are to be placed on, a respective surround (32) is provided for fixing the tabletops (1) at their longitudinal inner edges (13), the surround being in the form of an angled stop with an edge engaging over at the top and under which the longitudinal inner edges (13) can be slid; and b) the tabletops (1) are fixed, on the other hand, in the vicinity of their longitudinal outer edges (12), to the side struts (4).

5. The table as claimed in claim 4, wherein a) the strut mounts (23) on the transverse supports (2) are of upwardly open V-profile;

b) the side struts (4) are essentially an upwardly open V-profile (40) which, at least with the pointed, lower region, find space with a suitable shape in the strut mounts (23), the V-profile (40) having at the top on both sides horizontal chamfered portions (41) which are used as a support for and securing of the tabletops (1); and c) the fastening between the side struts (4) and the transverse supports (2) and between the side struts (4) and the tabletops (1) is realized in a spot-type manner by means of screws (49',49).

6. The table as claimed in claim 5, wherein a) at least one of the horizontal chamfered portions (41), which are present at the top on both sides, of the side strut (4) is adjoined by a downwardly pointing transition (44) which opens into a support edge (45), as a result of which, when the tabletops (1) are resting on the horizontal chamfered portions (41) of the respective side strut (4), a respective gap remains between the underside (11) of the respective tabletop (1) and the support edge (45);

b) a container (9') is provided with a useful space (90') and an adaptor region (94') intended for fitting onto the side strut (4);

c) the container (9') is dimensioned for the insertion of a CPU of a computer; and d) the adaptor region (94') has a depression (95') which runs longitudinally, extends over the width of the container (9') and in which the V-profile (40) of the side strut (4) together with the strut mount (23), which supports the latter, of the transverse support (2) finds space.

7. The table as claimed in claim 6, wherein a) the useful space (90') is formed by a base (91') and the two side walls (92', 92') extending upward therefrom, and the rear side (93') and the topside are likewise open, thus enabling free access into the container (9') from the front and rear;

b) at the top of the depression (95'), facing the rear side (93'), there is an upwardly directed stop edge (97'), and running parallel to the latter on the depression (95'), facing the front side, is a bent-over portion (96') which points toward the depression (95');

c) in the fitted state, the bent-over portion (96') of the container (9') engages over the support edge (45) and the stop edge (97') of the container (9') is present on a second support edge (45) on the opposite side of the side strut (4), at the point where said second support edge is situated, in the case of a symmetrical cross-sectional profile of the side strut (4); and d) the suspension and position of the center of gravity of the container (9') in the fitted state cause it to be aligned toward the center of the table, the supported tendency of the container (9') to tilt being reinforced as said container is loaded.

8. The table as claimed in claim 7, wherein a) on both sides of the channel (3), below the plane of the tabletops (1) to be placed on, a respective supporting edge (34), which points way from the channel (3), is provided for supporting and fixing the tabletops (1) at their longitudinal inner edges (13); and b) on both sides of the channel (3), below the plane of the inserts (8) to be placed on, set-down surfaces (33) pointing into the channel (3) are provided in each case, in order to support said inserts.

9. The table as claimed in claim 8, wherein a) the supporting edges (34) and the set-down surfaces (33) are formed by a profiled material strip fixed on the channel (3); and b) the surround (32) is a continuation of the wall of the channel (3).

10. The table as claimed in claim 9, wherein a) the channel (3) includes a base surface (30), installation apertures (301) can be provided in the base surface (30) as a means of access for lines and/or installations; and b) a tabletop extension (1') is provided which can be attached transversely and is supported by bridge struts (5') which are fastened, on the one hand, in the respectively aligned side strut (4) and, on the other hand, in strut extensions (5) arranged on the underside (11').

11. The table as claimed in claim 10, wherein on the head portion (63) of the legs (6) and on the leg mounts (22) on the transverse supports (2) there are mutually complementary screwing elements (630,631;220,221).

12. The table as claimed in claim 11, wherein a) in the case of the leg (6), one leg portion (64) extends from the head portion (63) to the standing surface (S);

b) two legs (6', 6') emerge from the head portion (63), said legs spreading apart and being formed in each case by a leg profile (60); and c) a height-leveling device (7) is contained in the leg (6); and d) there emerges from each lower leg end (640,640) a base element (66) which is arranged displaceably, can be adjusted by means of the height-leveling device (7) and the set-down surface (660) of which is provided for supporting on the standing surface (S).

13. The table as claimed in claim 12, wherein in the case of the leg (6)

a) the height-leveling device (7) comprises an adjusting screw (78) which is accessible from the outside, is arranged in the head portion (63) and carries along a rotating spindle (71) on which a rocker element (73) is mounted in an oscillating manner;

b) in the leg portion (64) with the two legs (6',6') spread apart, a respective axially displaceable slide rod (70,70) is mounted in the respective leg profile (60,60) of said leg;

c) the upper ends of the two slide rods (70,70) butt against the rocker element (73) which determines, by means of its set height position, the push-in depth of the slide rods (70,70); and d) the slide rods (70,70) act on the respective base element (66,66).

14. The table as claimed in claim 13, wherein a) the base element (66) has a cross section which corresponds in principle to the clear internal cross section of the leg profile (60) at the lower leg end (640); and b) the set-down surface (660), which is situated right at the bottom of the base element (66), is an oblique plane which compensates for the oblique position of the leg portion (64) with respect to the standing surface (S).

15. The table as claimed in claim 14, wherein a) either a coupling element (65), to which the slide rod (70) is fastened at the top and the base element (66) is fastened at the bottom, is fitted between the lower end of a slide rod (70) and a base element (66); or b) the base element (66) and the coupling element (65) form an integral constructional unit; and c) the coupling element (65), which is separate or is connected integrally to the base element (66), is arranged in the leg profile (60) in a manner such that it can be displaced axially over a defined region.

16. The table as claimed in claim 15, wherein a) the leg profile (60) is, in principle, of U-shaped cross section with a rear wall (600) and the two side walls (601,602) which are adjacent to the latter and lie opposite each other; and b) a leg covering (68) is provided for covering the open side lying opposite the rear wall (600).

17. The table as claimed in claim 16, wherein a) the inserts (8;80,81,82,83,84,85), differently configured, which can have at least one aperture (800,811,841,850) and/or a groove (810,820,830,840) can be placed over the channel (3), aa) the aperture (800,811,841,850) being used for receiving a socket unit (89) or for the insertion of a support (92), and the support (92) bearing a light (91), and ab) structures can be inserted into the groove (810,820,830,840), in the form of a possibly axially displaceable and/or rotatable, horizontal panel (96), a possibly axially displaceable and/or rotatable book/file support (97) or a vertically standing screen (98);

b) structures (9) are provided for arrangement at and/or on the tabletops (1), which structures can easily be positioned and displaced or removed again, by sliding over the table edge (12); and c) such structures (9) are:

ca) a half-height, panel-shaped side screen (90) which forms a vertical delimitation on the table from the adjacent position and has an incision for securing it;

cb) a placemat (93) which lies on the first tabletop, therefore defines a workplace and has a bent-over edge at the front for securing it;

cc) a utensil tray or file/book support (94) which sits on the second tabletop and has a bent-over edge at the front for securing it;

cd) a high, panel-shaped side screen (95) with an upper part (950) standing above the second tabletop and a lower part (951) which forms a vertical delimitation into the vicinity of the standing surface (S), the side screen (95) having an incision for securing it; and ce) a collecting container (98) which extends essentially below the first tabletop and has an incision for securing it.

* * * * *